US006752134B1

(12) United States Patent
Wilkinson

(10) Patent No.: US 6,752,134 B1
(45) Date of Patent: Jun. 22, 2004

(54) IGNITION ARRANGEMENT

(75) Inventor: Roger Wilkinson, Covina, CA (US)

(73) Assignee: Pertronix, Inc., San Dimas, CA (US)

( * ) Notice: Subject to any disclaimer, the term of this patent is extended or adjusted under 35 U.S.C. 154(b) by 0 days.

(21) Appl. No.: 09/783,521

(22) Filed: Feb. 15, 2001

(51) Int. Cl.[7] ..... F02P 9/00

(52) U.S. Cl. ..... 123/609; 123/617; 123/625; 123/406.58; 123/406.59

(58) Field of Search ..... 123/609–625, 123/406.53, 406.58, 406.59, 644

(56) References Cited

U.S. PATENT DOCUMENTS

| | | | | |
|---|---|---|---|---|
| 3,874,354 A | | 4/1975 | Crouch | 123/595 |
| 3,933,140 A | | 1/1976 | Gynn | 123/595 |
| 4,058,103 A | | 11/1977 | Brocker | 123/595 |
| 4,125,103 A | * | 11/1978 | Jackson | 123/146.5 A |
| 4,149,508 A | | 4/1979 | Kirk, Jr. et al. | 123/598 |
| 4,224,917 A | | 9/1980 | Nakazawa et al. | 123/647 |
| 4,235,213 A | | 11/1980 | Jellissen | 123/146.5 A |
| 4,345,575 A | | 8/1982 | Jorgensen | 123/598 |
| 4,351,306 A | * | 9/1982 | Luckman et al. | 123/609 |
| 4,365,609 A | | 12/1982 | Toyama et al. | 123/635 |
| 4,406,272 A | | 9/1983 | Kiess et al. | 123/617 |
| 4,478,201 A | | 10/1984 | Asik | 123/620 |
| 4,499,888 A | | 2/1985 | Hino et al. | 123/615 |
| 4,508,092 A | | 4/1985 | Kiess et al. | 123/617 |
| 4,522,185 A | | 6/1985 | Nguyen | 123/637 |
| 4,901,704 A | | 2/1990 | Safranek | 123/599 |
| 5,028,868 A | | 7/1991 | Murata et al. | 324/207.2 |
| 5,058,559 A | | 10/1991 | Koiwa | 123/612 |
| 5,076,249 A | | 12/1991 | Ikeuchi et al. | 123/613 |
| 5,093,617 A | | 3/1992 | Murata et al. | 324/235 |
| 5,097,209 A | | 3/1992 | Santos | 324/207.2 |
| 5,126,663 A | | 6/1992 | Shinjo | 324/207.2 |
| 5,127,387 A | | 7/1992 | Matsuo | 123/617 |
| 5,158,056 A | | 10/1992 | King | 123/414 |
| RE34,183 E | * | 2/1993 | Wilens et al. | 123/414 |
| 5,197,448 A | | 3/1993 | Porreca et al. | 123/620 |
| 5,365,909 A | | 11/1994 | Sawazaki | 123/617 |
| 5,406,926 A | | 4/1995 | Gu | 123/617 |
| 5,638,799 A | | 6/1997 | Kiess et al. | 123/637 |
| 5,803,059 A | | 9/1998 | Jacobs et al. | 123/595 |
| 6,050,242 A | | 4/2000 | Wilkinson | 123/406.58 |
| 6,123,063 A | | 9/2000 | Boerjes | 123/598 |

OTHER PUBLICATIONS

"Ignitor Better Fuel Economy" Advertisement of Pertronix, Inc. "Never Change Pointas Again" Advertisement of Pertronix, Inc. "Ignitor Electronic Ignition" Catalog of Pertronix, Inc., p. 40 "Euroepan Car", Apr., 1994, p. 8 "All Chevy", Feb., 1994.
"VW Trends", Apr. 1994 "Super Chevy", Jun. 1994 "Musclecar Resoration & Performance", Jun. 1993, p. 76, Et Sec. "Hide Some Horses Under Your Cap", Advertisement of Pertronix, Inc.

* cited by examiner

*Primary Examiner*—Willis R. Wolfe
*Assistant Examiner*—Johnny H. Hoang
(74) *Attorney, Agent, or Firm*—Don Finkelstein

(57) ABSTRACT

An improved electronic ignition arrangement for an internal combustion engine having an output drive shaft, a rotary shaft drivingly coupled to the output drive shaft, a plurality of spark plugs, an ignition coil, and a rotor and distributor arrangement to effect sequential firing of the spark plugs, the rotor coupled to the rotary shaft for rotation therewith, the ignition system arrangement producing a software modifiable control signal routed to the ignition coil to effect optimal sequential firing conditions for the ignition col and spark plugs and thereby improving performance of the engine.

74 Claims, 8 Drawing Sheets

IGNITION ARRANGEMENT

BACKGROUND OF THE INVENTION

1. Field of the Invention

This invention relates to the field of ignition systems for internal combustion engines, and in particular to an improved electronic ignition system that replaces breaker point type ignition systems and less capable ignition systems.

2. Brief Description of the Prior Art

Electronic distributor ignition systems for replacement of point type distributors are well known in the art. Basically, such electronic ignition systems receive their timing information from the distributor camshaft and convert the changing angular position of the camshaft into a series of pulses for ultimately creating a spark for distribution to the spark plugs in a timed relationship to the rotation of the distributor camshaft. Several electronic ignition systems of the prior art modulate a source of either magnetic or optical flux. A sensor within the engine distributor housing monitors the modulated signal. Electronics associated with the sensor detects the modulated signal, then generates and transmits a trigger signal for the spark. Synchronization of the modulation source with the position of distributor camshaft sets the timing of the spark.

The use of Hall-effect devices in electronic ignition systems is also known in the art. In some cases, a single magnet and a single Hall-effect device are spaced apart, and a rotatable object timed with the camshaft passes through the magnetic flux between the magnet and the Hall-effect device, inducing an output from the Hall-effect device. In other arrangements, a pair of magnets with a single Hall-effect device between them, or a pair of Hall-effect devices with a single magnet between them, are employed, but the same technology is relied upon, i.e. producing spark timing pulses by the passing of a rotatable disc-like object, or objects, within the magnetic field, or fields, standing between the magnet(s) and Hall-effect device(s).

One such prior art device can be found in U.S. Pat. No. 5,406,926 to Huan-Lung Gu. This reference shows, in one embodiment, a spark ignition system for an internal combustion engine having a radially extending vane mounted on the distributor rotor shaft and rotates therewith. The vane, at its radially outer end has an axially extending portion which passes by a Hall-effect sensor. The number of axially extending portions is the same as the number of cylinders. The distributor rotor is also mounted on the shaft and is spaced from the vane. An integral part of the apparatus is a stray noise isolating plate (10) extending across the distributor and separating the rotor from the vane. As the shaft rotates, a signal is generated to initiate the spark. Other embodiments have multiple vanes for generating additional signals used for other engine functions. Another embodiment shows a distributorless system with a plurality of coils. There is no distributor rotor, but the top of the unit is closed by the stray noise isolating plate. In some embodiments, the second vane is asymmetrical and provides a signal for fuel injection. While not specifically called out, the structure shown seems to indicate that the axially extending portion passes between the Hall-effect unit and a magnet.

U.S. Pat. No. 5,158,056 to Raymond King shows an ignition system for a spark ignition engine in which a hub is mounted on the camshaft and has a plurality of magnets mounted on the periphery of the hub. A stationary magnetic sensor detects each magnet as it passes during each rotation and generates the signal for the spark ignition.

U.S. Pat. No. 5,127,387 to Haruyuki Matsuo shows a spark ignition signal generator in which a radially extending plate is mounted on a shaft rotated by the engine. At the radially outer end of the plate are tabs bent to be axially oriented. A stationary magnet is positioned in spaced relationship to the Hall-effect unit and the tabs pass between the Hall-effect unit and the magnet on each rotation. The apparatus is directed to the particular shape of the plate.

U.S. Pat. No. 5,126,663 to Izuru Shinjo shows the detailed design for a particular type of mounting for a Hall-effect unit in which a spring type arm provides a resilient force to the plate on which the Hall-effect unit is mounted, allegedly eliminating distortion to the Hall-effect unit.

U.S. Pat. No. 5,097,209 to Alfred J. Santos shows a spark ignition system for an internal combustion engine. A plate is mounted around the shaft of the distributor and extends radially outward. A pair of rings are on the plate, and each mounts a plurality of magnets in spaced apart relationship. Hall-effect units are fixed in place and detect the passage of the magnets. Two Hall-effect units are used to detect the outer ring of magnets to provide two signals for each passing magnet. A single Hall-effect unit detects the inner magnets as they pass to provide a single signal. The signals are used to initiate the spark.

U.S. Pat. No. 5,093,617 to Shigemi Murata shows various arrangements of a Hall-effect unit as used in an ignition timing system for internal combustion engines. In the first embodiment, a toothed wheel passes by a front surface of a Hall-effect sensor unit, and the magnet is mounted behind the back surface of the Hall-effect unit. Rotation of the toothed wheel is synchronous with the engine. In all the other embodiments, the toothed wheel passes between the magnet and the Hall-effect unit. The signal generated is used to control engine functions.

U.S. Pat. No. 5,028,868 to Murata et al. shows a flux shutter which is similar to the vane of the aforementioned '926 patent and which passes between the magnet and the Hall-effect unit to generate an engine signal for ignition timing control. In all embodiments, the axial portion of the vane passes between the magnet and the Hall-effect unit. Several different mounting arrangements for the Hall-effect unit and magnet are shown.

U.S. Pat. No. 4,901,704 to Edward J. Safranek reference shows an engine ignition timing structure in which a plurality of magnets are positioned on the outer rim of the flywheel of an engine and rotate therewith. A stator assembly has the coils and four Hall-effect units mounted thereon to sense the passage of the axial portions 6 and 7 of the flux concentrators 29*a* and 29*b* which rotate with the flywheel along with a ring magnet 28 which is spaced from the fixed Hall-effect units. The signal generated by the Hall-effect units is used for ignition timing through a circuitry designed to eliminate the dependency of ignition timing on engine RPM.

U.S. Pat. Nos. 4,508,092 and 4,406,272 to Kiess et al. show a distributorless ignition system in which, in one embodiment, a single Hall-effect unit is positioned between two magnets in a spaced apart relationship radially outward from a rotating shaft. A disc is connected to the crank shaft of the engine for rotation with the shaft, and axially extending flange like members at different radial positions pass through the gaps formed between the magnets and the Hall-effect units. This sequentially generates two signals from the Hall-effect unit, one positive and one negative. These signals are processed through differential amplifiers and Schmidt triggers to a micro processor which utilizes the positive signal for operation of the spark in cylinders 1 and 4 and the negative signal for operation of the spark in cylinders 2 an 3. In a second embodiment, there are provided two Hall-effect units with a spaced magnet between them. The same type of flanges move between the magnet and the Hall-effect units to provide the two output signals. A third embodiment is similar to the first and is linearly arranged for detecting linear motion.

U.S. Pat. No. 4,224,917 to Nakazawa et al. concerns the known idea of using a signal pickup device, amplifying the signal that is picked up, and transmitting the amplified signal to an ignition coil. Magnetic poles 5 are situated opposite the rotor tips and sense the passing of the rotor tips. The alleged new features are the placement of the amplifier circuit, or the amplifier circuit and output transistor in a waterproof housing on the outside of the distributor housing.

U.S. Pat. No. 4,235,213 to Jellissen concerns the known idea of using a signal pickup device for providing timing signals for an engine ignition distributor system. The apparatus uses a modified rotor assembly 20 having downwardly extending ferrous vanes for passing through the gap of a Hall Effect device.

U.S. Pat. No. 4,365,609 to Toyama et al. concerns the known idea of using a signal pickup device, amplifying the signal picked up, and transmitting the amplified signal to an ignition coil. An electromagnetic pickup 2 is situated opposite the rotor tips and senses the passing of the rotor tips. The main features of the apparatus according to this patent are the provision of an ignition coil in the distributor and the orienting of the magnetic field of the ignition coil relative to the magnetic detector to minimize erroneous ignition timing.

U.S. Pat. No. 4,499,888 to Hino et al. uses a coil/core-sensor to detect a rotating "signal rotor 1*a*" and employs resonant circuit technology. A simple routing arrangement is used for sending the sensed signal from an oscillatory signal generator unit 1, through an amplifier and on to the ignition coil U.S. Pat. No. 5,058,559 to Koiwa discloses a means for developing an ignition timing signal which is applied to an ignition coil via a simple amplifier circuit shown in FIG. 4. The signal pickup 14 is not well defined, and no rotating magnets are suggested.

In U.S. Pat. No. 5,076,249 to Ikeuchi et al., the signal pickup and routing is similar to that of Koiwa described above, except that the Ikeuchi apparatus uses light sensing techniques to determine shaft angular position. There is no suggestion to use moving magnets.

U.S. Pat. No. 5,365,909 to Sawazaki et al. proposes the use of a pair of disc plates each having folded portions passing through the gap of a Hall Effect device. The reference does not suggest rotating magnets, and no signal processing function is suggested.

All of the devices and apparatuses of the prior art, in the implementation of an electronic ignition system, have one or more shortcomings. Specifically, many prior art devices require a completely new mechanical design for the distributor, and therefore cannot be adapted to fit existing engines without great expense. Additionally, especially for owners of vintage automobiles or boats, the owners do not want to replace genuine distributors with non-genuine ones. They would reject to notion of improving engine performance if it meant that the engine would not retain its original visual characteristics and charm.

Yet, it is recognized by those skilled in the art that precise timing and dwell period of an engine is critical to its performance. Using the electronic ignition systems of the prior art, while timing may be precisely set, it can vary substantially from the preset condition upon the degradation of components, tolerance of parts, variation of battery power due to discharging and charging cycles, variation of the trigger point in the circuitry receiving the output from the sensor, imprecise threshold detection of analog waveforms having inherently wide range detection windows, and other similar factors.

There is a need in the art for an improved electronic ignition system which has more accurate and stable timing and dwell characteristics, substantially independent of aging of parts, power variations, and critical threshold requirements, and which can be designed to produce precise timing and dwell parameters applicable to a variety of different engines and/or engine types.

In addition, there is a need in the art to dynamically alter timing and dwell parameters in real time. In this connection, there is a need to automatically alter timing and dwell parameters differently when the engine is starting than when it is running, as well as when the engine transitions from starting to running. Dynamic performance regulation and correction requires a close monitoring of changing engine parameters such as engine RPM. The present invention satisfies these needs and more.

DEFINITIONS

In describing the operation of the invention, certain mechanical and functional features and relationships will be defined and explained. The following definitions will assist in understanding the terms used herein.

Camshaft axis is the longitudinal axis of the camshaft, more generally referred to herein as a "rotary shaft", of a distributor for an internal combustion engine. A typical camshaft has radially projecting lobes, and is described herein as rotating clockwise or counterclockwise as the camshaft would be viewed from above, i.e. as it would be observed from the top of the distributor.

Camshaft rotational direction refers to the clockwise or counterclockwise rotational movement of the distributor camshaft as viewed from above, i.e. as it would be observed from the top of the distributor. Dwell period and timing are both affected by the rotational direction of the camshaft for a given sensor arrangement.

Timing refers to the time coincidence of a spark generated by the ignition system and the position of a piston as determined by the angular position of the camshaft driven in synchronism with the crankshaft of an engine.

Dwell refers to the portion of the timing cycle between spark generations in which current builds up in the primary of the ignition coil.

It is to be noted that the dwell period is vital to the performance of all induction ignition systems. It is during this period that current in the primary of the ignition coil increases. The current that is flowing in the primary at the time of the spark and the inductance of the primary are the key parameters that determine the energy available for the spark. The energy available for spark generation determines the available voltage for the spark and the spark duration. Both voltage and spark duration are essential to reliable ignition of the fuel-air mixture. Thus, the importance of the dwell period cannot be overstated.

In the description to follow, it will be assumed that the camshaft sensing arrangement may be constructed from discrete functional components, or it may include a Hall-effect integrated circuit (HEIC). A technical description of the operation of an HEIC as a gearwheel tooth speed and position indicator is presented in an article by Klaus Fischer entitled Dynamic differential all-effect ICs measure speed, position and angle in a publication "APPLICATIONS—AUTOMOTIVE ELECTRONICS" (1997) No. 4, such publication being incorporated herein by reference.

SUMMARY OF THE INVENTION

An improved electronic ignition arrangement for an internal combustion engine having an output drive shaft, a rotary shaft coupled to the output drive shaft, a plurality of spark plugs, an ignition coil, and a rotor and distributor arrangement to effect sequential firing of the spark plugs, the rotor coupled to the rotary shaft for rotation therewith, the ignition system arrangement producing a software modifiable control signal routed to the ignition coil to effect sequential firing conditions for the ignition coil and spark plugs and thereby improving performance of the engine.

The principles of the present invention can be applied during the design of a new engine and freely manufactured to mechanical engineering specifications at the discretion of the manufacturer or designer. However, the invention will have major application in retrofitting older engines by directly replacing older breaker point type ignitions systems, or by directly replacing certain prior art electronic ignition system arrangements, with a new and improved one, without any redesign or mechanical alterations to the engine or distributor, and without altering the visual aspects of the engine or distributor.

The operating parts of the invention fit under the original or stock distributor cap and has only two wires to hook up. Available as a kit of parts, the invention can be installed easier and more conveniently within the existing distributor of an engine than a set of breaker points and condenser. Being modular and with all electronics encased in a sealed ignitor module housing, the present invention is not affected by dirt and dust and is virtually waterproof. Due to the intelligent microprocessor based controller in the ignitor module, shifts due to points wear, condenser or points failure, and periodic replacement of points are non-existent considerations. Moreover, with close and continuous monitoring of certain engine parameters, the present invention provides consistency in engine performance, improved fuel mileage, positive starting, and longer plug life.

In one aspect of the invention, there is provided an ignition arrangement for analyzing a selected operating condition of an internal combustion engine, and making an adjustment to a designated engine parameter associated with the selected operating condition, in accordance with predetermined specifications.

As non-limiting examples: when the selected operating condition is engine starting, that is, when the engine is making the transition from the crankshaft in a non-rotating condition thereof to the crankshaft in a rotating condition thereof under the power of the electrically powered starter driven by the battery the adjustment increases dwell period; when the selected operating condition is engine running, that is, when the engine is rotating the crankshaft under its own power the adjustment decreases dwell period; when the selected operating condition is the value of ignition coil current lower than a preset value just before spark, the adjustment increases dwell period; when the selected operating condition is the value of ignition coil current greater than a preset value just before spark the adjustment decreases dwell period; when the selected operating condition is the sensed RPM greater than a preset value, the adjustment increases advance; when the selected operating condition is engine not turning over, the adjustment terminates dwell mode, reinitializes all starting parameters, and waits for a power-on reset; when the selected operating condition is engine running, and ignition coil current is lower than a preset value, the adjustment increases dwell period; and when the selected operating condition is engine running, and ignition coil current is higher than a preset value, the adjustment decreases dwell period.

In adapting the invention to existing engines with breaker point type distributors, in one aspect of the invention, the ignition system arrangement comprises a magnet carrier mountable on the rotary shaft for rotation therewith, the carrier having a plurality of magnetic regions spaced about the periphery of the rotary shaft, a sensor positionable in close proximity to ones of the plurality of magnetic regions as the magnet carrier rotates, the sensor producing a sensor output signal representing the passing of each magnetic region by the sensor, and an ignitor module, responsive to receiving the sensor output signal, for producing the control signal and making it available to the ignition coil.

In a preferred embodiment of the invention, the magnet carrier is an annular ring insertable over the rotary shaft and adapted to be fixed to the underside of the rotor. In an alternative version, the magnet carrier comprises an annular sleeve adapted to fit over the lobe member fixed to the rotary shaft beneath the rotor (e.g., over the lobe member of the crankshaft).

In another aspect of the invention, there is provided an improved ignition arrangement for an internal combustion engine comprising an apparatus for producing a series of electrical pulses in synchronism with the rotary shaft sequentially rotating through predetermined angles of rotation, and an ignitor module, responsive to receiving the series of electrical pulses, for exciting the ignition coil at the end of each dwell period, the ignitor module comprising a processor for analyzing the series of electrical pulses to determine when the engine is starting and when it is running, and for altering the dwell period responsive to such determination.

An additional, or alternative, function of the ignitor module is to increase the dwell period when the processor determines that the engine is starting and to decrease the dwell period when the processor determines that the engine is running.

In another aspect of the invention, the ignitor module is adapted to monitor the ignition coil current just prior to generating a spark, and to adjust the dwell accordingly for optimum operating efficiency and spark energy.

In another aspect of the invention, the ignitor module is adapted to dynamically adjust the dwell only to a period sufficiently long that the peak current level is reached just before the dwell period ends, thereby providing constant spark energy over the RPM range of the engine.

BRIEF DESCRIPTION OF THE DRAWING

Further objects and advantages and a better understanding of the present invention may be had by reference to the following detailed description taken in conjunction with the accompanying drawings in which:

FIG. 2 is a top perspective view of a magnet ring representing an example of a virtually limitless number of similarly constructed magnetic rings, depending upon engine type, manufacturer, number of cylinders, available space in the distributor, engineering and design factors, and the like;

FIG. 4 is a front perspective view of a magnet sleeve and magnet retainer combination, representing an example of a virtually limitless number of similarly constructed magnetic sleeves, depending upon engine type, manufacturer, number of cylinders, available space in the distributor, engineering and design factors, and the like;

DETAILED DESCRIPTION OF THE PREFERRED EMBODIMENTS

Figure 1:
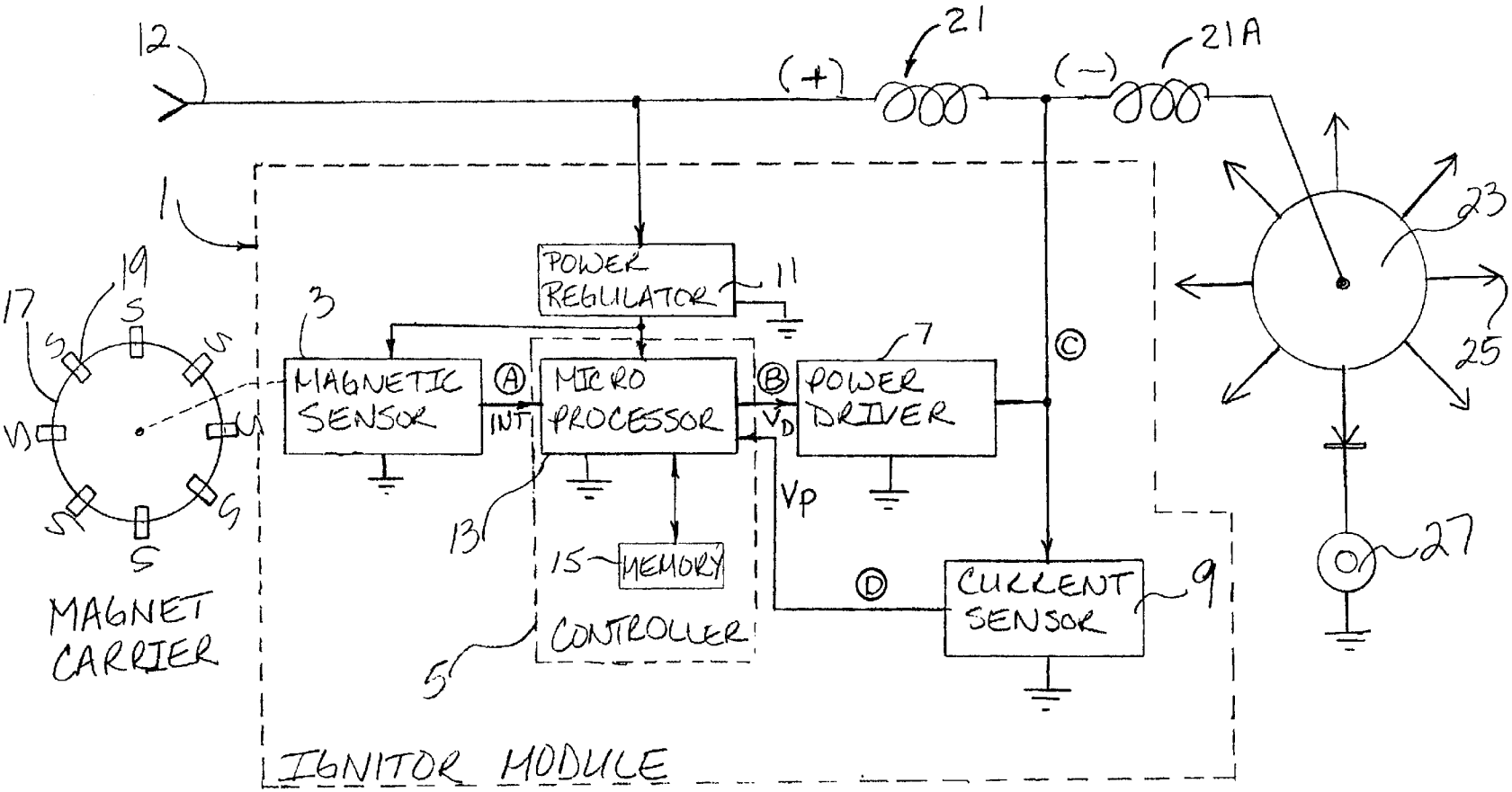
FIG. 1 is a basic block diagram of the ignition arrangement, in accordance with the present invention, including a rotatable magnet carrier, an ignitor module, an ignition coil, a spark distributor, and a representative spark plug.

The basic block diagram of FIG. 1 depicts an ignitor module 1 making up the electronics portion of the ignition arrangement in accordance with the present invention. The ignitor module 1 includes functional blocks shown as magnetic sensor 3 controller 5, power driver 7, current sensor 9, and power regulator 11. Regulator 11 which supplies regulated DC power to the functional electronic blocks of the ignitor module 1.

The controller 5 is comprised of a microprocessor 13 and a memory 15 which, although shown as a separate functional block in FIG. 1, may be an integral part of the microprocessor. It is shown separate in FIG. 1 for ease of description which follows.

A magnet carrier 17, external to the ignitor module 1 and fitted to the rotary shaft of an engine, carries a number of permanent magnets 19 about its periphery, with the south poles of each magnet 19 oriented to align with an adjacent magnetic sensor 3. The magnet carrier 17 is designed specifically for each application. That is, for some engine distributors, the magnet carrier 17 may be a magnet ring (FIG. 2) affixed to the underside of the distributor rotor (FIG. 3), or it may be in the form of a magnet sleeve (FIGS. 4 and 5) that fits snugly over the camshaft lobe member 28 (FIG. 6) of the distributor.

Upon sensing the passing of a magnetic south pole, sensor 3 provides a pulse, indicated as signal A in FIG. 1, to an interrupt (INT) input of microprocessor 13 in controller 5. Microprocessor 13 analyzes all aspects of the input pulses from sensor 3 and outputs a control signal, indicated as signal B in FIG. 1, to power driver 7 the output of which, indicated as signal C in FIG. 1, drops to a low state to begin current flow in ignition primary coil 21 which start the dwell period. At the end of the dwell period, microprocessor 13 turns off power driver 7, thereby presenting an open circuit to any current flow through ignition primary coil 21. The magnetic field about coil 21 thus collapses creating a spark potential, as is known in the art. Further details of the operation of ignition module 1 will be presented in connection with the description of FIGS. 8–12.

FIGS. 2–5 show various views of the two types of magnet carriers just described.

Figure 2:
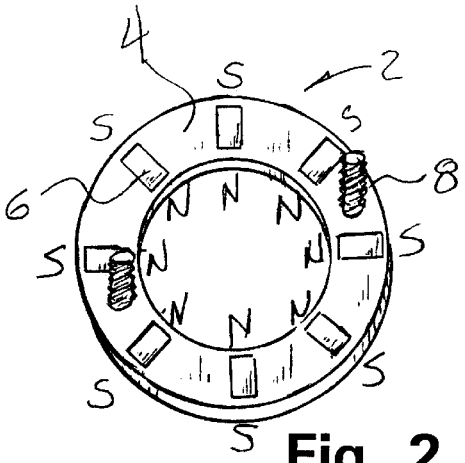
Figure 3:
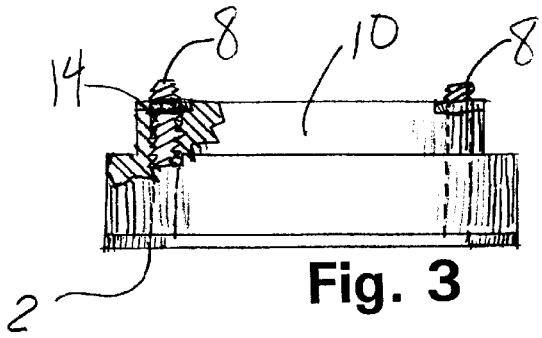
FIG. 3 is a side elevational view of one type of rotor with the magnet ring of FIG. 2 installed on its underside.

FIG. 2 is a top perspective view of a magnet carrier 2 in the form of an annular ring 4 carrying a number (in this example, eight) permanent magnets 6 in the orientation indicated above. A pair of upwardly extending screw studs 8 are provided on opposite sides of the magnet ring 2 which, during installation, are inserted through the holes used to mount a rotor of the type shown in FIG. 3, and are secured to the rotor 10 using nuts 14 after the rotor 10 is reinstalled in the distributor.

Figure 4:
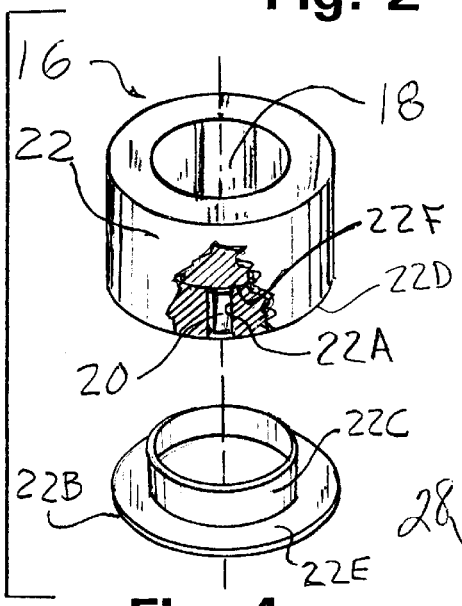

FIG. 4 is a front perspective view of a magnet sleeve 16 having a main cylindrical body 22 with an inside surface 18 which conforms to the size and shape of the lobes 30 and valleys 32 of a lobe member 28 (FIG. 6) of the distributor camshaft 26.

Magnets 20 are contained within pockets 22A provided in the bottom portion of main body 22. Main body 22 has an internal shoulder 22F against which magnets 20 abut when they are inserted in pockets 22A from the bottom of main body 22. A retainer ring 22B has a cylindrical extension 22C which slide fits within a conforming opening in the bottom of main body 22 until annular ring member 22E mates with the bottom of main body 22. Any appropriate means are used to fix retainer ring 22B to main body 22.

Figure 5:
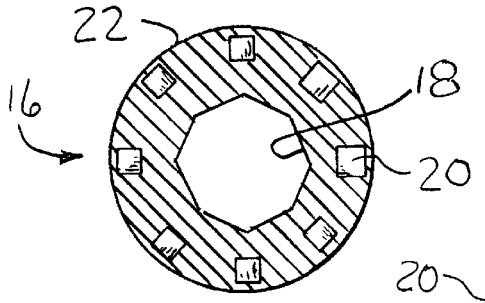
FIG. 5 is a partial cross sectional view taken perpendicular to the axis and just above the bottom of the magnet sleeve shown in FIG. 4, looking upward.
Figure 5A:
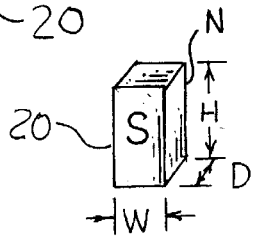
FIG. 5A is an enlarged view of one of the magnets shown in FIGS. 4 and 5.

FIG. 5 is a bottom view of the magnet sleeve 16 of FIG. 4 showing the relative position of the permanent magnets 20 polarized with the south poles pointing radially outwardly of the magnet sleeve 16, and the north poles pointing radially toward the center of the magnet sleeve 16. There are potentially may forms for the magnet ring or magnet sleeve. A typical magnet ring or sleeve holds one of three sizes if magnets (refer to FIG. 5A):

| Height (H) | Depth (D) | Width (W) |
|---|---|---|
| 0.250" | 0.100" | 0.120" |
| 0.200" | 0.100" | 0.120" |
| 0.200" | 0.100" | 0.080" |

All magnets are charged across the 0.100"depth dimension.

The magnet sleeve 16 holds the same number of magnets 20 as there are engine cylinders/spark plugs. That is, a four cylinder engine will have four equally spaced magnets, one magnet for every 90 degrees of rotation. Similarly, a six cylinder engine and an eight cylinder engine will require six and eight magnets, respectively. The number of magnets, their spatial position, and orientation for the magnet ring 2 of FIG. 2 follow the same rules as just explained for the magnet sleeve 16 of FIGS. 4 and 5.

Again using the magnet sleeve 16 as an example, the magnets 20 are oriented relative to the lobes 30 of the distributor camshaft 26 and the position of the magnetic sensor 3 (FIG. 1), such that, for distributers without vacuum advance, the sensor 3 responds to the rotating south pole of the magnet sleeve 16 when the center of the rotor contact (not shown) is aligned with the center of the contacts in the rotor cap (not shown). For those distributors with vacuum advance, the magnets 20 and magnetic sensor 3 are oriented such that the magnetic sensor 3 responds to the south pole of the magnet at the time the trailing portion of the rotor contact is aligned with the center of the contacts in the distributor cap (not shown).

Figure 7:
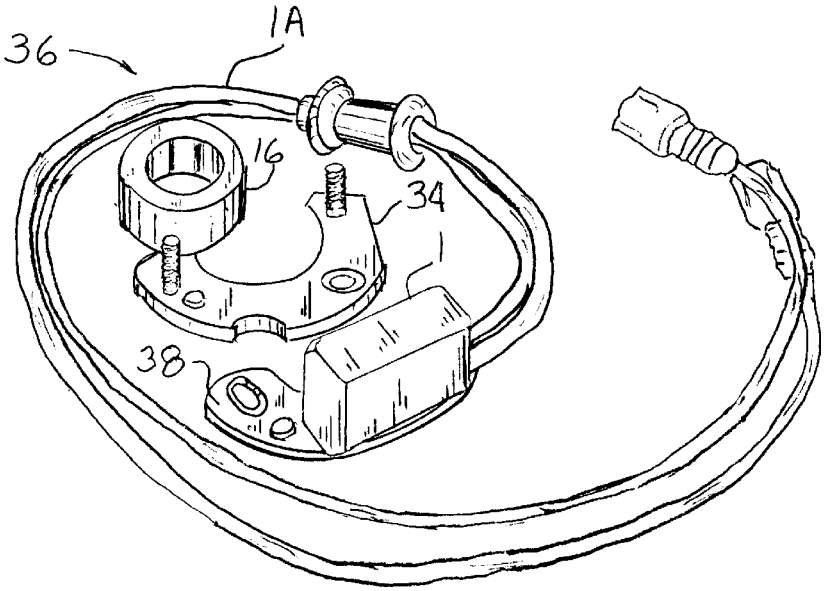
FIG. 7 is a perspective view of a kit of parts which replaces conventional breaker point hardware within a distributor of an internal combustion engine.

FIG. 7 shows a kit of parts 36 which includes all of the items necessary, excluding mounting fastener hardware (screws, washers, nuts), to replace a breaker point set and condenser of an engine of the prior art. The kit 36 consists of an ignitor module 1 mounted on an aluminum chassis plate 38, an adapter plate 34, a magnetic sleeve 16, and a pair of wires 1A which are to be connected to an ignition coil.

The ignitor module 1 is manufactured as a molded module fixed to an aluminum chassis plate 38. The molded module houses the electronics shown within the ignitor module functional block 1 in FIG. 1. Its size is approximately 1.20 inches wide, 0.87 inches tall, and 0.54 inches thick. The ignitor module 1 fits on the distributor plate within the distributor (not shown), under the distributor cap (not shown). The aluminum chassis plate 38 provides the foundation for mounting the ignitor module 1 to an adaptor plate 34 that is mounted to the distributor plate (not shown) within the distributor (not shown). The structural elements indicated as not being shown in the drawing are common elements that would be immediately understood as to configuration and function by those of ordinary skill in the art.

Each adaptor plate 34 is designed specifically for a particular engine application. The forms of the various plates 34 and the mounting holes in them are designed to ensure proper orientation of the ignitor module 1 and correct alignment of the holes in the adaptor plate 34 with the existing mounting holes in the distributor plate (not shown). The ignitor module 1 is oriented so that, at the time of the approaching south pole of the magnet sleeve 16, the rotor (not shown) is close to the contact in the rotor cap (not shown). This assures achieving proper phasing. The adaptor plates 34 are also designed so that the mechanical and vacuum advance functions of the distributor are not altered. Of utmost importance, the adaptor plate 34 provides good electrical conductivity from the aluminum chassis of the ignitor module 1 and chassis plate 38, which is the ignitor module circuit ground, to the distributor plate. It is assumed that the electrical conductivity for the distributor plate through the distributor to the engine block and back to the battery (–) is very high.

Figure 8:
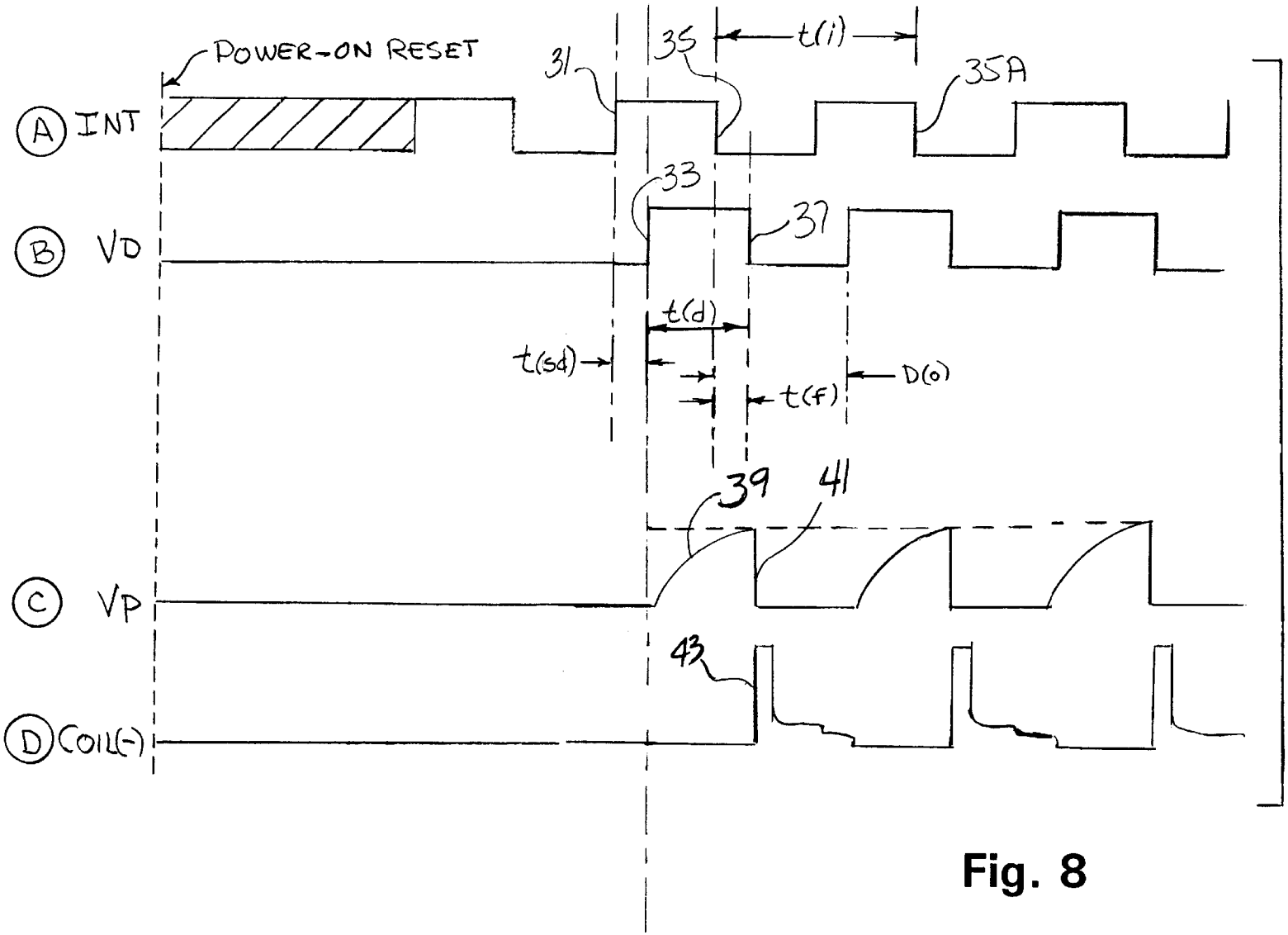
FIG. 8 is a timing chart showing, from startup, waveforms developed by the sensor, the microprocessor in the controller of the ignitor module, the power driver connected to the ignition coil, and the ignition coil primary current sensor, shown in FIG. 1.

For the following description, reference is made to the system block diagram of FIG. 1, the waveform timing diagram of FIG. 8, and the flow diagrams of FIGS. 9–12. Letters designating waveforms A, B, C, and D in FIG. 8 correspond to like letters in FIG. 1 showing where such waveforms can be observed, measured, or monitored.

Figure 9:
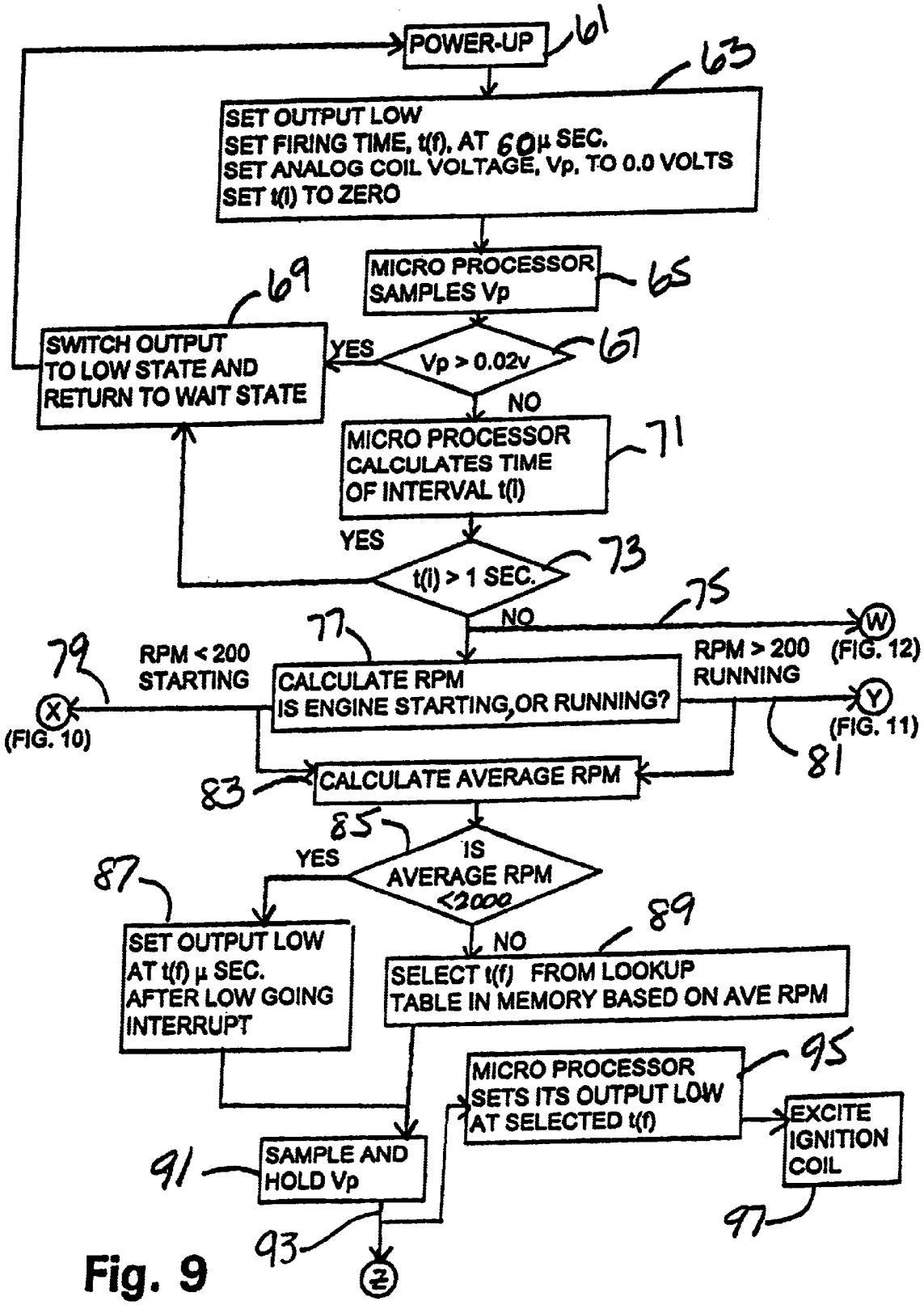
FIG. 9 is a flow chart illustrating certain functions performed by the microprocessor in the controller from startup to exciting the ignition coil, according to one embodiment of the invention.

At power-up, in function block 61 of FIG. 9, the controller 5 initiates all key variables. That is, as shown in function block 63, the microprocessor 13 output, $V_D$ (waveform B), will be set low, the firing delay time t(f) is set at 60 $\mu$sec, the starting dwell is set at 15 milliseconds, the analog ignition coil voltage Vp (representing, at C in FIG. 8, the amount of ignition primary coil current) is set to 0.0 volts, and the accumulated history files in microprocessor 13 and memory 15 for the pulse interval time t(i) is set to 0.

Figure 6:
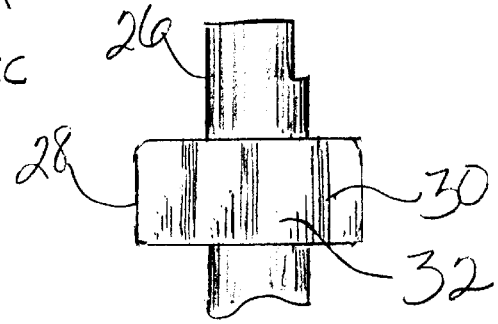
FIG. 6 is a slightly enlarged, relative to FIGS. 4 and 5, partial elevational view of the top of a distributor camshaft showing a lobe member having equally spaced lobes and valleys about its periphery.

As the starter of the engine rotates the engine crankshaft (not shown), the magnet carrier 17 rotates with the distributor camshaft 26 (FIG. 6). The magnet sensor 3 is located sufficiently close and at an elevation relative to the magnets 19 in magnet carrier 17 that it receives positive flux from the south poles of the rotating magnets 19.

The magnet sensor 3 is a semiconductor that switches states when a positive flux normal to its surface is greater than a preset threshold. When the positive normal flux becomes greater than the preset threshold, the magnet sensor 3 switches from a high to a low output. In the absence of a positive flux level below the preset threshold, the magnet sensor 3 switches from a low output to a high output. The high and low outputs corresponding to positive magnetic flux and the absence of positive flux are shown by the timing line A in FIG. 8. It is this signal, also designated as signal A in FIG. 1, that is applied to the interrupt input INT of microprocessor 13.

After the engine has started, the interaction of the south poles of the magnets 19 with the magnet sensor 3 continue as described in the previous paragraph.

The microprocessor 13 of the controller 5 receives and processes the signal from the magnet sensor 3. Prior to receiving the first signal from the magnet sensor 3 the microprocessor 13 is in a quiescent state as dictated by either the power-up reset or a commanded shut down.

Upon stabilization of the interrupt (INT) input to microprocessor 13 at A (FIG. 8) following a power-on reset and the occurrence of the next rising edge 31 of INT, and after a predetermined time delay t(sd), where t(sd) is approximately 100 microseconds, the microprocessor 13 will immediately switch its output VD to the gate of power driver7 to a high state. The rising edge 33 of VD forces power driver 7 output to a full conductive low state. This starts the dwell phase, and current in the primary of the ignition coil 21 starts building for the entire dwell time t(d), as seen by reference to the rising edge 39 of Vp and the time lines and waveforms B and C in FIG. 8.

For this embodiment of the invention, t(sd) is the delay from the start of the positive duty cycle that current in the primary will start. Since the invention can be used with any coil, there is the concern that too long a dwell could result in excessive current. For that reason, this embodiment delays the start of dwell 100 microseconds following the rising edge of INT. As explained hereinafter, the start of dwell and the dwell period is adaptive. It is this adaptive process that results in effective sparks thoughout the RPM range without excessive heat dissipation in either the coil or the ignitor module.

On the falling edge of INT, the microprocessor 13 waits for a preset-programmed delay t(f) and then commands the power driver 7 to the off state. This preset delay is software controllable and it is for offsetting electronic retarding at the higher RPMs as explained in hereinafter. In accordance with the normal induction process, the interruption of primary current in the ignition coil primary 21 initiates the spark. This sequence continues until the engine is started.

At the beginning of the first dwell period t(d) of every starting sequence, the microprocessor 13 monitors the primary current in the ignition coil. The microprocessor 13 samples and converts the analog voltage Vp, waveform C in FIG. 8, to an eight bit digital word which is compared to limits preset in the software. It is to be noted that the voltage Vp is a representation of the current flowing through the primary of ignition coil 21 by means of a current sensor 9, basically a low ohmic, highly stable, high wattage, sensor resistor, outputting a proportional voltage waveform shown at time line C in FIG. 8. The sampling of Vp by microprocessor 13 is shown in FIG. 9 as function block 65.

If the converted digital word is greater than the preset value, there is a problem with either the coil or the installation of the ignition arrangement. To protect against any damage to either the ignition arrangement or the ignition coil 21, the microprocessor 13 stops the dwell period and waits for another power-on reset. This is achieved in function block 67 which makes a decision as to the level of Vp. If Vp is greater than 0.02 volts, microprocessor 13 will immediately switch the output to a low state and return to a wait state as indicated in function block 69. The microprocessor 13 shall remain in the wait state until receiving another power-up reset. A Vp greater than 0.02 volts immediately at the start of the first dwell period t(d) indicates there is a malfunction in the ignition system that must be corrected. Otherwise, severe damage could occur to the ignition components.

If the decision in function block 67 is "NO", upon the falling edge 35 of the interrupt INT, the microprocessor 13 performs the following function.

It calculates the time of the pulse intervals, t(i) at function block 71. Function block 73 makes a decision as to whether or not the time of interval t(i) is greater than 1 second. If such decision is "YES", the microprocessor 13 again sets the output $V_D$ to a low state and returns to a wait state waiting for another power-up reset as indicated in function block 69.

It should be noted that an interval t(i) greater than 1 second indicates that the engine has stopped running. The interval can be calculated only after the second falling edge 35A of the interrupt INT.

Assuming t(i) is not greater than one second, a "NO" decision in function block 73 is determined and, as indicated in function block 77, the microprocessor 13 calculates RPM and determines if the engine is starting or running.

Alternative to the calculation of t(i) to determine if an engine has stalled, the dwell period t(d) is measured, and if the dwell period exceeds 125 msec, the algorithm senses that the engine has stalled. For a stalled engine, the dwell period t(d) is terminated, all critical parameters are re-initialized, and the microcontroller 5 awaits another start. A power-up reset is not required to restart the engine. Reestablishment of the parameters is all that is required.

If the first negative going interrupt INT since power-up is sensed, the engine is starting, and microprocessor 13 recognizes that condition. The microprocessor 13 then calculates RPM, and if decision block 77 determines that the calculated RPM is less than 200 (e.g., for a 6-cylinder engine—for an 8-cylinder engine, the starting engine RPM will be 150, and for a 4-cylinder engine, the starting engine RPM will be 300), the engine is in a starting mode, and this information is available at the event line 79, to be revisited in connection with the description of FIG. 10. If microprocessor 13 determines that the RPM is greater than 200, then the engine is in a running mode, such information being available on event line 81 to be further described in connection with FIG. 11.

Assuming a running condition, determined by function block 77, microprocessor 13 calculates the average RPM in function block 83. Average RPM is based on the average time intervals between the last four successive low going interrupts INT. Until four intervals have occurred, the average engine RPM will be based on the average of the first three intervals, the average of the first two intervals, or the length of the first interval, in that order of priority.

The next decision block 85 tests the value of the average RPM. If the engine is starting, or if it is running at an average RPM less than 200 (for a 6-cylinder engine, for example), represented by a "YES" decision in block 85, the microprocessor 13 will set the output $V_D$ low at t(f)$\mu$sec (e.g., 60 $\mu$sec) after the low going interrupt INT.

On the other hand, if the engine is running at an average RPM greater than 200, a NO decision from function block 85 results in the microprocessor 13 accessing a look-up table inits memory 15 and selecting the appropriate t(f) for the average RPM. This is accomplished in function block 89. The microprocessor 1.3 will then set the output VD low at t(f)/^ sec after the low going interrupt INT. In this sense, it can be said that decision block 85 decides if compensation should be included in the timing for the retard that is inherent at the higher RPMs. At RPMs lower than 2000, the inherent retard due to the physical signal delay getting to the spark plugs and starting the spark is minimal. Therefore, the upper limit (maximum t(f)) is set at 2000 RPMs.

It is to be noted that the setting of the output $V_D$ low at a selected t(f) is indicated in function block 95. However, at some time just prior to the microprocessor 13 setting the output $V_D$ low, it will sample and hold the analog voltage Vp connected to the analog-to-digital port on the microprocessor 13, from current sensor 9. This is indicated in function block 91, the microprocessor 13 thus storing the converted voltage Vp for future use, made available as indicated by event line 93.

When the output $V_D$ is set low at the selected t(f), i.e. at the falling edge 37 of $V_D$, the ignition coil 21 is excited to create a high voltage pulse 43 in its secondary winding 21A which leads to the distributor 23 through an electrical contact 25 on the distributor cap and onto the associated spark plug 27 for firing it. At the same time, without any changing current through primary coil 21, due to power driver 7 releasing its output from ground potential, the sensed ignition coil current represented by Vp from current sensor 9, drops to zero as indicated by falling edge 41 on waveform C.

Figure 10:
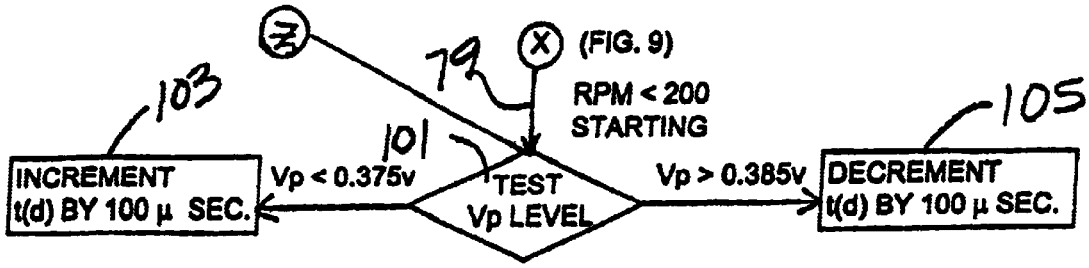
FIG. 10 is a flow chart, functionally associated with that of FIG. 9, indicating the function of incrementing or decrementing the dwell period based upon the processor detecting certain engine conditions when the engine is in a starting mode.

As seen in FIG. 10, where the symbol X is functionally related to the same symbol in FIG. 9, soon after the microprocessor 13 has set the output $V_D$ low, it will test the analog voltage Vp in function block 101. If the engine is starting, and if Vp is less than 0.375 volts (7.5 amperes), t(d)

is incremented by 100 μsec in function block 103. However, if Vp is greater than 0.385 volts (7.7 amperes), t(d) is decremented by 100 μsec in function block 105. Otherwise, t(d) is unchanged.

Microprocessor 13 is adapted to ensure that there is a constraint imposed such that the intervals t(i) between low going interrupts INT, minus t(d) shall never be less than 700 μsec. That is, t(d)<t(i)−700 μsec.

Figure 11:
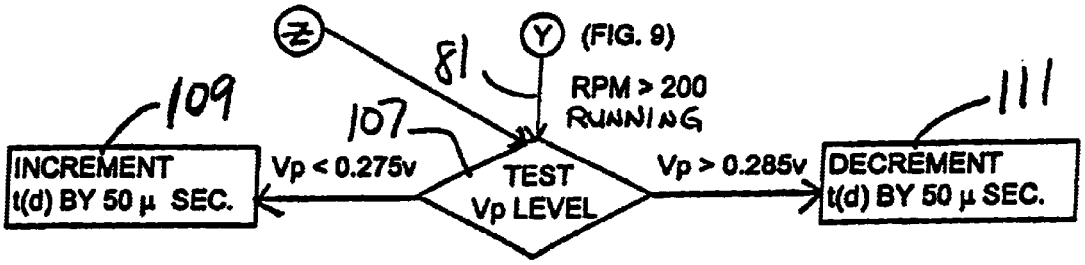
FIG. 11 is a flow chart, functionally associated with that of FIG. 9, indicating the function of incrementing or decrementing the dwell period based upon the processor detecting certain engine conditions when the engine is in a running mode.
Figure 12:
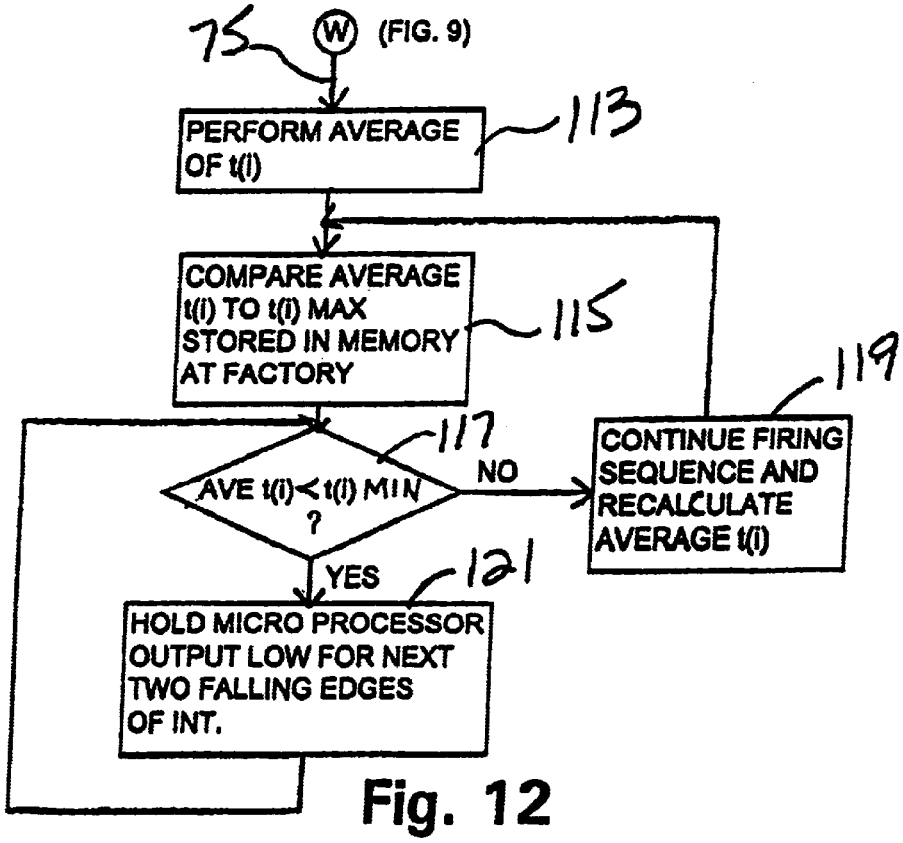
FIG. 12 is a flow chart, functionally associated with that of FIG. 9, illustrating the function of the microprocessor in the controller for maintaining the average pulse interval time to be less than a predetermined amount.

FIG. 11 deals with the running mode of the engine and associates the symbol Y with the same symbol in FIG. 9. Accordingly, if the engine is running, a test is made of the Vp level in function block 107. If Vp is less than 0.275 volts (5.5 amperes), t(d) is incremented by 50 μsec On the other hand, if Vp is greater than 0.285 volts (5.7 amperes), t(d) is decremented by 50 μsec Incrementing is accomplished in function block 109, while decrementing is accomplished in function block 111. Otherwise, t(d) is unchanged. As with the starting mode of the engine, in the running mode, the constraint that the interval t(d) between low going interrupts INT shall never be less that 1 m sec Another, optional, function of the microprocessor 13 is to limit the maximum RPM of the engine. This is accomplished 25 using the flow chart of FIG. 12 where the symbol W is associated with the same symbol shown in FIG. 9.

The microprocessor 13 will perform an average of the pulse interval time t(i) in function block 113 and then, in function block 115, will compare the average t(i) to t(i)max stored in memory 15 at the factory. The test for such a comparison is made in function block 117. If the average t(i)<t(i)min, the microprocessor 13 will hold the output mode for the next two falling edges of the external interrupt INT, indicated by block 121 with a "YES" decision made in function block 117.

The microprocessor 13 will then check the next measured t(i) with t(i)min, and if t(i)<t(i)min, the microprocessor will again hold the output mode for the next two periods. On the other hand, if t(i)>t(i)min, the microprocessor 13 will continue the firing sequence and recalculate the t(i) average as indicated in function block 119. Otherwise, the microprocessor 13 will again compare t(i) to t(i)min and repeat the above process until t(i)>t(i)min.

The detailed description of the operations of the invention given above represents the currently preferred embodiments of the invention. Processing schemes other than those specifically shown and described can produce the same, or similar, results. Accordingly, the invention is not to be limited to the preferred embodiment set forth herein.

In any ignition arrangement employing the concepts presented herein, certain system functions can be achieved.

Problems with the ignition coil or faults in the installation of the invention will cause the microprocessor 13 to stop the dwell period t(d) and wait for another power-on reset.

The microprocessor constantly monitors engine performance and through a start-up algorithm determines when the engine has started. Immediately after engine starting, the microprocessor measures the primary current in the ignition coil 21 just prior to spark generation. The microprocessor 13 samples the current in the ignition coil 21 and, after the engine has started, reduces the dwell period and then adapts the dwell according to measured primary current. It increases the dwell period of the coil current is low, and decreases the dwell period if the current is high. Within the limitations of the ignition coil 21 being used and the minimum fire time, the microprocessor 13 holds the peak coil current constant and within the boundaries set by software.

As with all electronic systems, there is an inherent delay from an input to an output signal. For an electronic ignition system, there is a corresponding delay from the input signal marking the position of the crankshaft relative to the spark at the spark plug. At low engine RPMs, this delay results in a small crank angle offset. However, at the higher RPMs, this delay can result in 1 to 2 degrees of timing retard. To compensate for this timing retard at the higher RPMs, the invention advances the timing as the RPMs increase. An algorithm measures RPM and, based on the RPM, calculates the advance necessary to compensate for the inherent retard at that RPM. This algorithm minimizes the timing inaccuracies resulting from uncompensated inherent electronic delays.

If for any reason the engine stalls, the microprocessor 13 senses that the engine is not running and takes the ignition system out of the dwell mode and waits for the reestablishment of INT which may be, but is not necessarily, a power-on reset. This ensures that an engine is not left in the dwell mode for long periods. Depending on the coil 21 being used, stalling in the dwell mode could result in damage to the coil 21 and to the ignition system. The present invention precludes this and ensures graceful shut down of the coil current.

The present invention increases the dwell period when the engine is starting. This increases the available energy for the starting sparks. As a result, the engine starts easier and quicker, particularly in cold weather.

The invention constantly adapts the dwell period. As described, just prior to the spark, the primary current in the ignition coil 21 is monitored. If the current is lower than a preset value, the dwell is increased. If the current is greater than a preset value, the dwell is decreased. The invention adapts the dwell to changing engine and coil conditions. As a result, within the limits of the ignition coil and operating voltages, the invention sustains constant energy over varying engine RPMs and operation conditions. This results in constant spark energy and more reliable fuel/air combustion.

Other ignition systems extend the dwell period and then limit the current. This approach to controlling the primary current and spark energy dissipates considerable power in the coil and in the ignition module, particularly at low RPM's. Dissipation of the excess power in the coil and in the module increases the operating temperatures of the coil and the ignition module. This reduces operational reliability.

The invention opens the dwell only to a period sufficiently long that the peak current level is reached just before the spark. As a result of this adaptive dwell approach to controlling the spark energy, the power dissipated and the operating temperatures are minimized, and the ignitor module 1 operates at a cooler temperature and with a higher inherent reliability.

With the provision of a power regulator 11 in the ignitor module 1 of the present invention, the electronics in ignitor module 1 receive constant DC operating voltage independent of power variations of the battery source. Thus, when head lights, air conditioners, and accessories requiring substantial power, there is no significant power variation for the ignitor module electronics, resulting in consistent and constant parameters of the control signal sent to the ignition coil 21. This is especially important for maintaining exact and precise critical threshold requirements when analyzing the transition edges of the sensed rotor position by sensor 3.

Alternate Embodiment

Figure 13A:
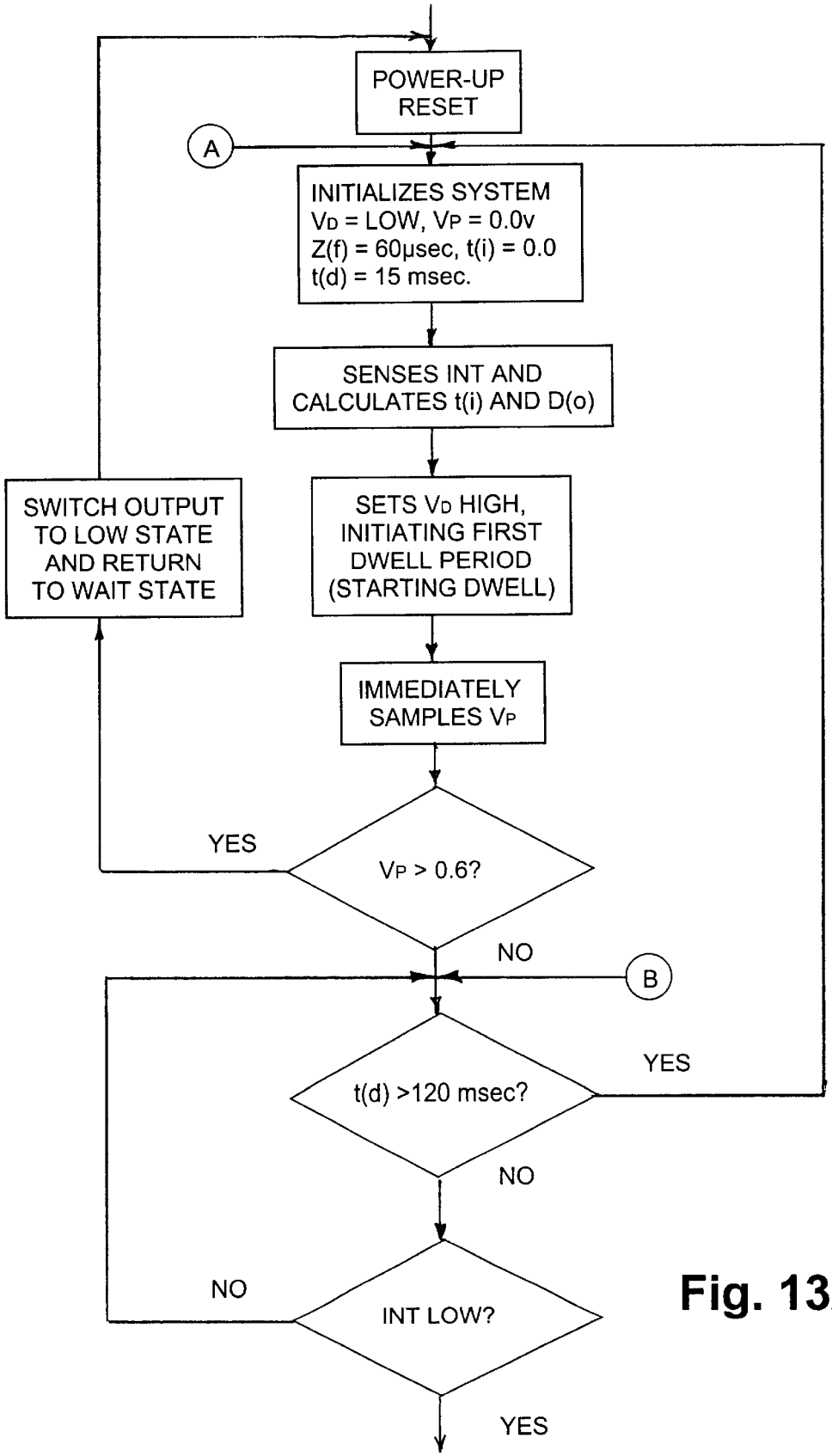
FIGS. 13A–13C is a flow chart spanning three drawing sheets for convenience and clarity of presentation, illustrating certain functions performed by the microprocessor in the controller from startup to exciting the ignition coil, according to an alternate embodiment of the invention.
Figure 13B:
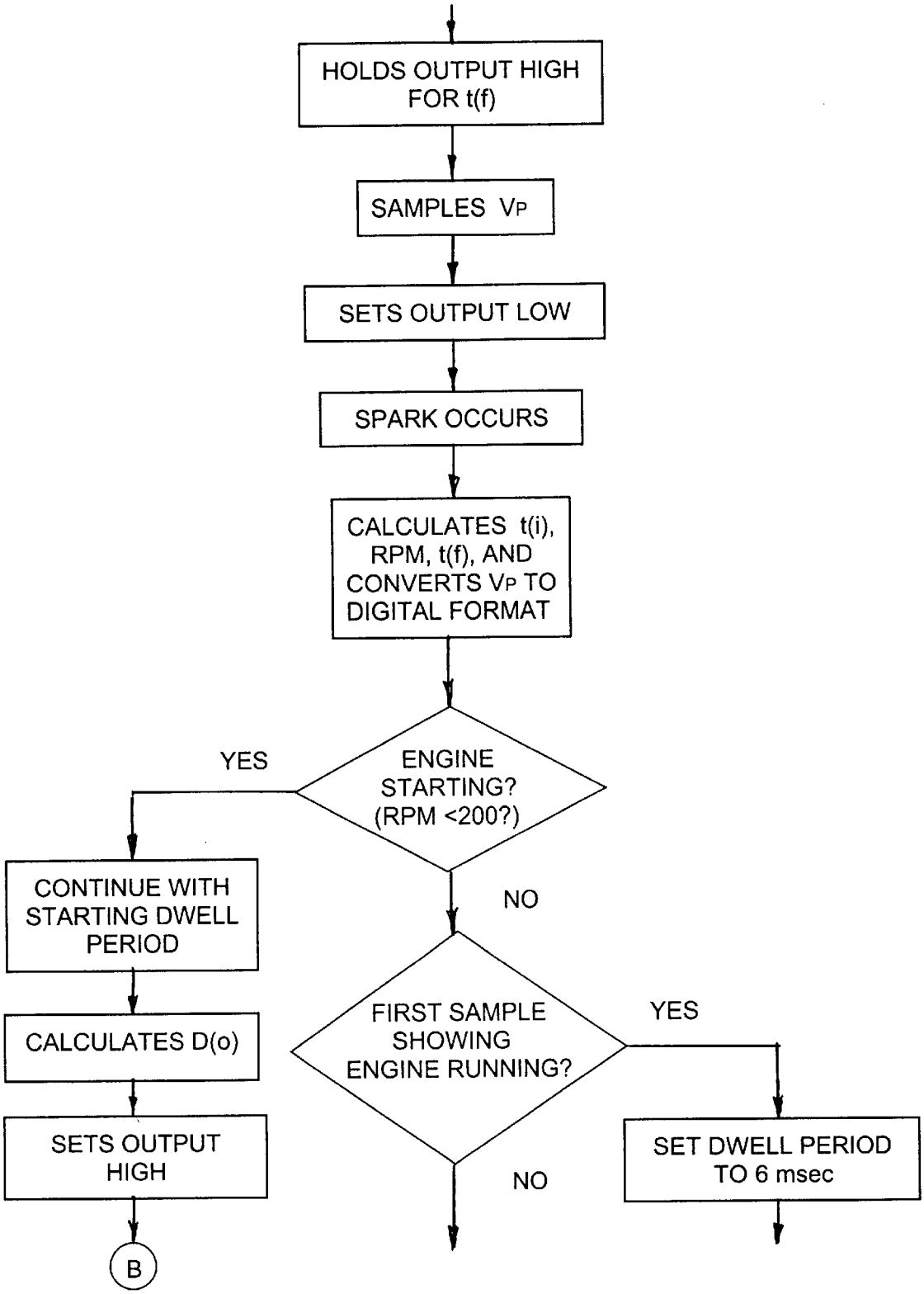
Figure 13C:
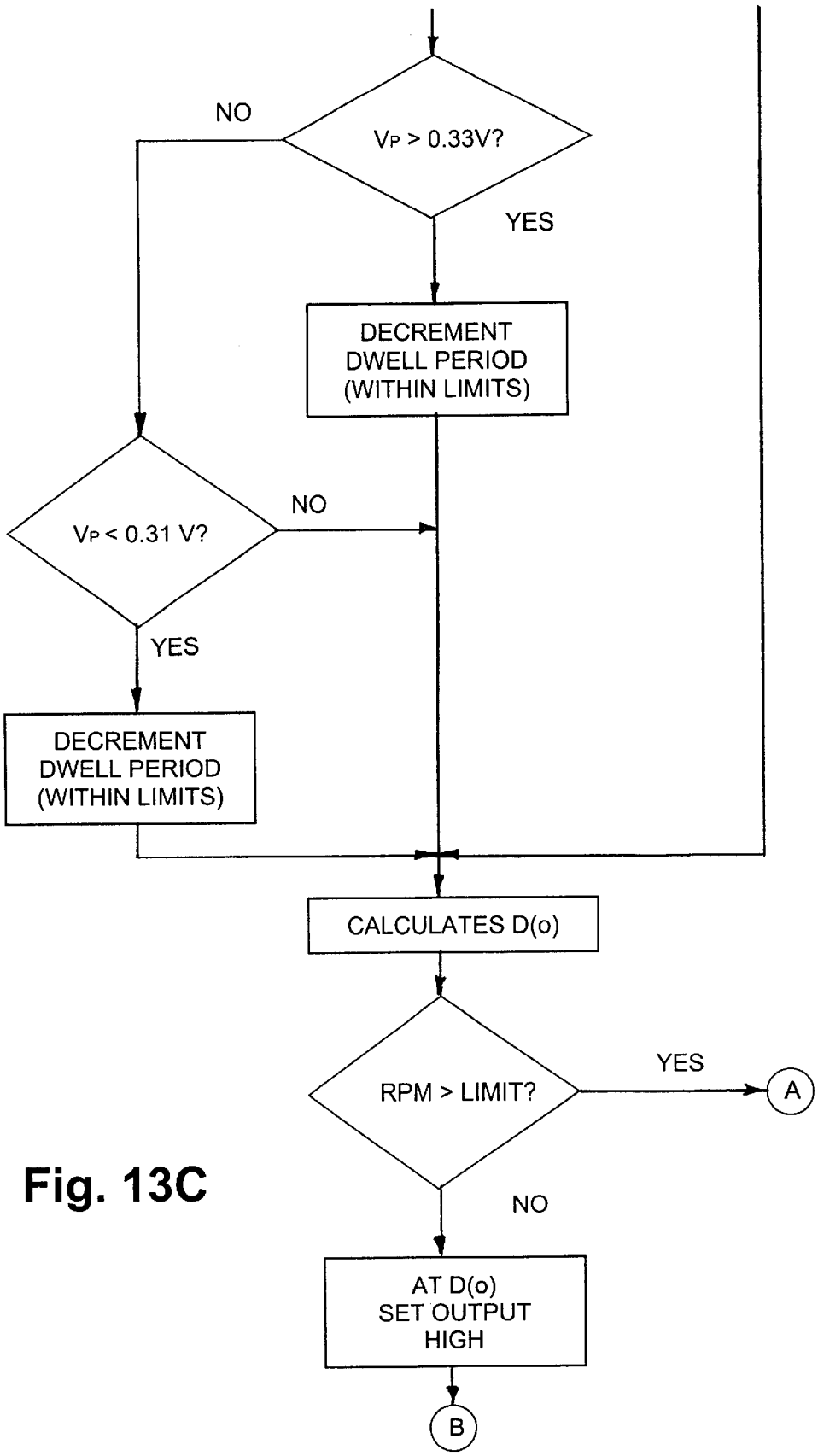

For the following description, reference is made to the system block diagram of FIG. 1, the waveform timing diagram of FIG. 8, and the flow diagrams of FIGS. 13A–13C.

With reference to FIG. 8, the following timing relationships clarify the meaning of D(o), t(i), t(f), Vp, and t(d). It is to be noted that, for the alternative embodiment, the timing value t(sd) is not used and can be ignored in FIG. 8 when analyzing the operation of the alternative embodiment of the invention.

t(i) is the time between falling edges of the INT into the microcontroller. It is the time between sparks.

t(f) is the time from the falling edge of INT to the occurrence of the spark.

t(d) is the time of the dwell period.

D(o) is the dwell offset.

Vp, as before, is the voltage created by the current in the primary of the coil across the sense resistor at the time of the spark.

From FIG. 8, it can be appreciated that the following mathematical relationship exists: t(i)=D(o)+t(d)−t(f).

The software keeps track of t(i) and Vp. Based on t(i), a software algorithm calculates t(f). As the RPMs increase, t(f) is linearly decreased. This linear function for t(f), based on t(i), compensates for the timing retard that otherwise would occur at the higher RPMS. As a result, timing remains constant over a large range of RPMs.

The alternate embodiment of the invention is defined by the flow chart depicted in FIGS. 13A–13C. Several difference in the functioning of this alternative embodiment will be evident noting the following highlighted features.

The minimum firing time is set at 650 microseconds. Firing time is the period t(i) minus the dwell period t(d).

The initial fire time delay, t(f), is 60 microseconds. As the engine RPM increases from a low preset value, t(f) is linearly reduced. At a preset high RPM limit, t(f) is reduced to zero.

The early dwell check made during the first dwell period after a power-on reset compares the converted voltage to 0.62 volts. If greater than 0.62 volts, the microcontroller shuts town the dwell and waits for another power-on reset.

The dwell period, when the engine is starting, is fixed at 15 milliseconds. As the engine is starting, the dwell period is not adapted to the coil current.

Once the engine is running, the dwell is set at the maximum running dwell of 6 milliseconds. It is this dwell that is adapted by sampling the coil current just prior to the spark.

The decision that the engine has stalled is made by monitoring the dwell period. If the dwell period is greater than 120 milliseconds, the microcontroller assumes the engine has stalled, shuts down the dwell period, and waits re-establishment of the INT. A power-on reset is not required.

The original embodiment of the invention employed an algorithm which checked the period t(i), and, if the period became greater than 1.0 second, shut down dwell and waited for a power-on reset. For ignition systems using very high performance coils, waiting 1.0 second could be catastrophic to the coil and the ignitor unit.

The original embodiment of the invention employed an algorithm which waited for a power-on reset. This required the user to turn the ignition switch to "off" before restarting. At times, a user may forget the necessity to turn the switch "off" before restarting. Also, there is no compelling reason to require a power-on reset.

In the alternative embodiment of the invention, the advance for compensating inherent high RPM retard is not a step function. The advance compensation occurs linearly from a low RPM limit to a high RPM limit.

The Vp limits for a running engine are decremented for Vp>0.33 volts and incremented for Vp<0.31 volts.

In the alternative embodiment of the invention, average RPM is not calculated, and performance decisions are not made based on average RPM.

FIGS. 13A–13C is a flow chart illustrating a preferred embodiment of certain functions performed by the microprocessor 13 in the microcontroller 5 from startup to exciting the ignition coil 21.

When a user turns an ignition key, or otherwise undertakes to start an engine, this action provides power to the power regulator 11 and begins to rotate the magnet carrier 17 (FIG. 1). The power-up event 131initiates a power-up reset in function block 133, as shown in FIG. 13A.

At power-up, the microcontroller 5 initiates all key variables. That is, as shown in function block 135, the microprocessor 13 output, VD (waveform b), will beset low, Vp is set to 0.0 volts, t(f) is set at 60 microseconds, t(i) is set to 0.0 milliseconds, and t(d) is set to 15 milliseconds.

Subsequently, INT is sensed, and t(i) and D(o) are calculated in block 137. In block 139, $V_D$ is set high as a result of the D(o) calculation, initiating the first dwell period, i.e., the starting dwell.

As indicated in function block 141, Vp is immediately sampled, and a test is made in block 143 to determine if the voltage created by the current in the primary of the coil 21 across a sense resistor (not shown) in current sensor 9, shown as Vp in FIG. 8, is in excess of 0.6 volts. If yes, the microcontroller 5 shuts down the dwell by switching the output of microprocessor 13, $V_D$, to a low state and returns to a wait state, waiting for another power-on reset.

If the decision in block 143 is no, a decision in block 147 is made as to whether or not t(d) exceeds 120 milliseconds. If so, the system is reinitialized at block 135. If not, a determination is made in block 149 as to the state of INT. If it is not low, t(d) is again measured and INT is again tested. When t(d) is greater than 120 milliseconds and INT is low, microprocessor 13 holds its output VD high for a period of time t(f) as shown at block 151.

Again, Vp is sampled, block 153, output $V_D$ is set to its low state, block 155, and a spark occurs (waveform D in FIG. 8) as indicated in block 157.

Function block 159 calculates t(i), RPM, and t(f), and converts Vp to digital format. The converted digital word for the analog voltage Vp is used by software for determining when to increase and decrease the dwell period T(d).

A decision is then made in block 161 to determine if the engine is running, i.e., if RPM is greater than 200. If the engine is still in the starting mode, the starting dwell period t(d) of 15 milliseconds is maintained, block 162, the dwell offset, D(o), is again calculated, block 163, and output $V_D$ is set high in block 164. As a result, t(d) is again tested in block 147, and the subsequent processing through function block 161 is repeated.

Upon detection of the first sample showing that the engine is running, block 165, the dwell period t(d) is readjusted to 6 milliseconds in block 166.

A decision is then made in block 173 as to whether or not the Vp is within a predetermined preferred operating range between 0.31 and 0.33 volts. If outside the range, dwell needs to be adjusted. Accordingly, if Vp is greater than 0.33 volts, dwell period is decremented, as indicated in block 175. If Vp is less than 0.31 volts, as determined in block 177, dwell period is incremented, as indicated in block 175. Otherwise, the system proceeds to calculate D(o) in function block 167.

RPM is then measured, and a determination is made in block 169 as to whether or not RPM is greater than a predetermined upper limit. If it is, the system is reinitialized in block 135. If RPM does not exceed the preestablished limit, the microprocessor 13 sets its output, VD, to its high state, as indicated at block 176 and t(d) is again tested in blocks 147 and 149 as described above.

It should be noted that, for all cases, with the engine running or starting, if the dwell period, t(d), exceeds 125 milliseconds, the microcontroller 5 discontinues the dwell period t(d), reinitializes all critical parameters, and awaits another start. If the engine stops when the coil 21 is in the fire period, t(f), the microcontroller 5 reinitializes all critical parameters and awaits for another INT sequence, as shown in FIG. 8. For this last situation, the microcontroller 5 does not need to discontinue the dwell period, t(d), since the coil 21 is in the fire period t(f).

While only certain embodiments have been set forth herein, alternative embodiments and various modifications will be apparent from the above description to those skilled in the art. These and other alternatives are considered equivalents and within the spirit and scope of the present invention.

What is claimed is:

1. In an internal combustion engine the improvement comprising in combination:

an ignition arrangement for said internal combustion engine;

said internal combustion engine having a distributor with a distributor cap;

said ignition arrangement for analyzing a selected operating condition of said internal combustion engine, and making an adjustment to a designated engine parameter associated with said selected operating condition, in accordance with predetermined specifications; and, said ignition arrangement sized and adapted to fit under said distributor cap of said internal combustion engine.

2. The arrangement as defined in claim 1, and further comprising:

said internal combustion engine having a coil for carrying an electric current, and said coil having dwell times; and, wherein said selected operating condition is dwell time; and said ignition arrangement checks and verifies, during a first dwell period, time that an ignition coil associated with said internal combustion engine is wired correctly and that the ignition coil is not shorted.

3. The arrangement as defined in claim 1, and further comprising:

said internal combustion engine further having:

a rotatable crankshaft adapted to rotate between a condition of non-rotation thereof to a condition of rotation thereof to preselected rotational RPM's; and a coil for carrying an electric current, and said coil having dwell times; and wherein:

said selected operating condition is said crankshaft commencing rotation from said non-rotation condition thereof to said rotating condition thereof; and said adjustment increases said dwell period.

4. The arrangement defined in claim 1, and further comprising:

said internal combustion engine further having:

a rotatable crankshaft adapted to rotate between a condition of non-rotation thereof to a condition of rotation thereof to preselected rotational RPM's; and a coil for carrying an electric current, and said coil having dwell times; and wherein:

said selected operating condition is said crankshaft in said rotating condition; and said adjustment decreases said dwell period.

5. The arrangement as defined in claim 1 and further comprising:

said internal combustion engine having:

an ignition coil for carrying an electric current having a variable magnitude and said coil having dwell times; and, a plurality of spark plugs operatively connected to said ignition coil, and said electric current of said ignition coil sequentially applied to said plurality of spark plugs to provide a spark therein; and wherein:

said selected operating condition is the magnitude of said current in said ignition coil lower than a predetermined value just before a spark in one of said plurality of spark plugs, and said adjustment increases said dwell period.

6. The arrangement as defined in claim 1 and further comprising:

said internal combustion engine having:

an ignition coil for carrying an electric current having a variable magnitude and said coil having dwell times;

a plurality of spark plugs operatively connected to said ignition coil, and said electric current of said ignition coil sequentially applied to said plurality of spark plugs to provide a spark therein; and wherein:

said selected operating condition is the magnitude of said current in said ignition coil greater than a preset value just before spark in one of said plurality of spark plugs; and said adjustment decreases dwell period.

7. The arrangement defined in claim 1 and further comprising:

said internal combustion engine further having:

a rotatable crankshaft adapted to rotate between a condition of non-rotation thereof to a condition of rotation thereof to preselected rotational RPM's;

said selected operating condition is the rotational rate of said crankshaft greater than a preset value; and said adjustment increases advance.

8. The arrangement as claimed in claim 1, and further comprising:

said internal combustion engine further having:

a rotatable crankshaft adapted to rotate between a condition of non-rotation thereof to a condition of rotation thereof to preselected rotational RPM's; and wherein:

said selected operating condition is said crankshaft of said engine in said non-rotating condition; and said adjustment terminates dwell mode and said adjustment re-commencing modification to said dwell mode for the condition of said crankshaft in said rotating condition thereof.

9. An ignition arrangement for an internal combustion engine having a rotatable drive shaft adapted to rotate from non-rotating condition thereof to a rotating condition thereof, an ignition coil having a variable magnitude current therein for generating high voltage energy pulses for distribution sequentially to a plurality of spark plugs for initiating a spark therein and having variable dwell times and said spark having a variable advance with respect to said orientation of said drive shaft, and said internal combustion engine having a distributor with a distributor cap, said ignition arrangement sized and adapted to fit under said distributor cap, and said internal combustion engine having a plurality of operating conditions and a plurality of engine parameters, and comprising, in combination:

a sensor sensing a rotational orientation and rate of rotation of said drive shaft; and an ignitor, responsive to said sensor sensing said rotational orientation and for calculation of said rate of rotation of said drive shaft, and said ignitor adapted to analyze a selected operating condition of the internal combustion engine, and make an adjustment to a designated engine parameter associated with said selected operating condition, in accordance with predetermined specifications.

10. The ignition arrangement as claimed in claim 9, wherein:

said selected operating condition is said crankshaft commencing rotation from said non-rotating condition thereof to a rotating condition thereof; and said adjustment increases said dwell period of said coil.

11. The ignition arrangement as claimed in claim 9, wherein:

said selected operating condition is said crankshaft of said engine in said rotating condition thereof; and said adjustment decreases said dwell period of said coil.

12. The ignition arrangement as claimed in claim 9, wherein:

said selected operating condition is the magnitude of said ignition coil current lower than a preset magnitude just before a spark in a spark plug; and said adjustment increases said dwell period of said coil.

13. The ignition arrangement as claimed in claim 9, wherein:

said selected operating condition is the magnitude of said ignition coil current greater than a preset value just before spark in a spark plug; and said adjustment decreases said dwell period of said coil.

14. The ignition arrangement as claimed in claim 9, wherein:

said selected operating condition is the rotational rate of said crankshaft greater than a preset value; and said adjustment increases said advance.

15. The ignition arrangement as claimed in claim 9, wherein:

said selected operating condition is a rotational rate of said crankshaft; and said adjustment linearly adjusts said advance between a preset minimum rotational rate to a preset maximum rotational rate of said crankshaft, and increasing said advance for increasing rotational rate and decreasing said advance for decreasing rotational rate of said crankshaft.

16. The ignition arrangement as claimed in claim 9, wherein:

said selected operating condition is said crankshaft in said non-rotating condition thereof; and said adjustment terminates said dwell mode for the condition of said crankshaft in said non-rotating condition, and said adjustment establishes said dwell mode for the condition of said sensor sensing said crankshaft in said rotational condition thereof.

17. The ignition arrangement as claimed in claim 9, wherein:

said selected operating condition is said crankshaft in said rotating condition thereof, and said magnitude of said ignition coil current is lower than a preset value; and said adjustment increases said dwell period.

18. The ignition arrangement as claimed in claim 9, wherein:

said selected operating condition is said crankshaft in said rotating condition thereof, and said magnitude of said ignition coil current is higher than a preset value; and said adjustment decreases said dwell period.

19. The ignition arrangement as claimed in claim 9, wherein:

said selected operating condition is the magnitude of said ignition coil current at a predetermined time at the initiation of a first dwell period; and said adjustment to a designated engine parameter associated with said selected operating condition comprises shutting down the dwell and waiting for a power-on reset, for the condition of said coil current greater than a predetermined value.

20. An ignition arrangement for an internal combustion engine having a drive shaft having a non-rotating condition for the condition of the engine not running and a variable rotational rate for the condition of the engine running, a rotary shaft drivingly coupled to and driven in synchronism rotation with the drive shaft, an ignition coil having a variable magnitude dwell period for the flow of current therethrough, a rotor and distributor arrangement, and a plurality of spark plugs, the rotor and distributor arrangement coupled between the ignition coil and the spark plugs to effect sequential firing of the spark plugs, said ignition arrangement comprising:

an ignitor module having a sensor;

said sensor responsive to the rotation of the rotary shaft to produce a series of electrical pulses having transitions representing the instantaneous position and rate of rotation of the rotary shaft; and said ignitor module operatively coupled to the ignition coil, said ignitor module responsive to receiving said series of electrical pulses from said sensor and sending a control signal to the ignition coil, said ignitor module analyzing said series of electrical pulses to determine a selected operating condition of the internal combustion engine, and making an adjustment to said control signal, thereby altering a designated engine parameter associated with said selected operating condition, in accordance with predetermined specifications.

21. The ignition arrangement as claimed in claim 20, wherein:

said ignitor module establishes a timing aspect of said control signal which sets the dwell period for the ignition coil; and said ignitor module comprising a controller for analyzing said series of electrical pulses to determine when the engine is starting and when it is running, and for altering said dwell period responsive to such determination.

22. The ignition arrangement as claimed in claim 21, wherein:

said controller increases said dwell period when said controller determines that the engine is commencing the transition from the non-rotating condition thereof to the variable rotational rate condition thereof.

23. The ignition arrangement as claimed in claim 21, wherein:

said controller decreases said dwell period when said controller determines that the engine is running.

24. The ignition arrangement as claimed in claim 21, wherein:

said controller is adapted to calculate the rotational rate of the engine by analyzing the time between like transitions in said series of electrical pulses, and to thereby determine that the engine is commencing the transition form the non-rotational condition thereof to the variable rotational rate condition thereof for the condition of the calculated rotational rate is less than a predetermined number and that the engine is in the variable rotational rate condition thereof for the condition for the condition of the calculated rotational rate is greater than a predetermined number.

25. The ignition arrangement as claimed in claim 21, wherein:

the magnitude of the current flow continuously rises in the ignition coil during the dwell period, and said controller is adapted to monitor the magnitude of the ignition coil current just prior to generating a spark and to adjust the dwell in accordance with a predetermined minimum magnitude of the coil current and a predetermined maximum magnitude of the ignition coil current.

26. The ignition arrangement as claimed in claim 25, wherein:

said controller increments the dwell period for the condition of the magnitude of the ignition coil current is less than a preset magnitude, and decrements the dwell period for the condition of the magnitude of the ignition coil current is greater than a preset value.

27. The ignition arrangement as claimed in claim 23, wherein:

said controller is adapted to calculate engine rotational rate by analyzing the time between like transitions in said series of electrical pulses; and said controller is further adapted to dynamically adjust the dwell only to a period sufficiently long that a predetermined peak current level in the ignition coil is reached just before the dwell period ends, thereby providing constant spark energy over the rotational rate range of the engine.

28. The ignition arrangement as claimed in claim 26, wherein:

said selected operating condition is dwell time; and said ignition arrangement checks and verifies, during a first dwell period, that the ignition coil associated with said internal combustion engine is wired correctly and that the ignition coil is not shorted.

29. A magnet carrier in a sensor arrangement for sensing the rotational orientation and rate of rotation of a rotatable drive shaft of an internal combustion engine, comprising:

a main body having a plurality of voids therein for receiving a like plurality of magnets sized and configured to fit into corresponding voids in said main body; and a retainer adapted to be fixed to said main body for confining said magnets in their respective voids and preventing the discharge of said magnets from said voids during operation of the internal combustion engine.

30. The magnet carrier as claimed in claim 29, wherein:

said main body is an annular ring; and said magnets are evenly distributed angularly within said voids in said main body, such that the magnetic fields of said magnets extend radially external to a peripheral edge of said annular ring.

31. The magnet carrier as claimed in claim 29, wherein:

said main body is cylindrically shaped;

said magnets are evenly distributed angularly within said voids in said main body, such that the magnetic fields of said magnets extend radially external to a peripheral cylindrical surface of said cylindrically shaped body; and said retainer is an annular ring secured to said main body.

32. The magnet carrier as claimed in claim 31, wherein:

said cylindrically shaped main body has axially spaced ends and a central opening at one of its ends; and said retainer has a center opening and a thin walled cylindrical member adjacent its center opening; whereby said retainer is secured to said main body by inserting said thin walled cylindrical member into said retainer central opening in an interference fit.

33. An ignition arrangement for an internal combustion engine of the type having a plurality of spark plugs associated therewith, an ignition coil associated therewith and said ignition coil having dwell times and ignition coil current, and said ignition coil current for sequentially causing sparkly in said plurality of spark plugs and said internal combustion engine having a plurality of operating conditions, for analyzing a selected operating condition of said plurality of operating conditions of said internal combustion engine, and making an adjustment to a designated engine parameter associated with said selected operating condition, in accordance with predetermined specifications:

a first of said selected operating conditions is dwell time, and checking and verifying, during a first dwell time, that said ignition coil associated with said internal combustion engine is wired correctly and that said ignition coil is not shorted.

34. The ignition arrangement as claimed in claim 33, sized and adapted to fit under a distributer cap of said internal combustion engine.

35. The ignition arrangement as claimed in claim 33 wherein:

a second of said selected operating conditions is engine starting; and said adjustment increases dwell time.

36. The ignition arrangement as claimed in claim 33 wherein:

a second of said selected operating conditions is engine running; and said adjustment decreases dwell time.

37. The ignition arrangement as claimed in claim 33 wherein:

a second of said selected operating conditions is a value of said ignition coil current in said ignition coil lower than a predetermined value just before spark; and said adjustment increases dwell time.

38. The ignition arrangement as claimed in claim 33 wherein:

a second of said selected operating conditions is a value of said ignition coil current in said ignition coil greater than a preset value just before spark; and said adjustment decreases dwell period time.

39. The ignition arrangement as claimed in claim 33 wherein:

a second of said selected operating conditions is an RPM greater than a preset value; and said adjustment increases advance.

40. The ignition arrangement as claimed in claim 33 wherein:

a second of said selected operating conditions is engine not turning over; and said adjustment terminates dwell mode waits for a power-on reset.

41. An ignition arrangement for analyzing a selected operating condition of an internal combustion engine having a plurality of operating conditions, and making an adjustment to a designated engine parameter associated with said selected operating condition, in accordance with predetermined specifications; and said internal combustion engine having a plurality of spark plugs, an ignition coil associated with said internal combustion engine and operatively connected to said plurality of spark plugs, and said ignition coil having ignition coil current therein and dwell times, and said ignition coil current for causing a spark sequentially in said plurality of spark plugs a first selected operating condition is engine starting; and said adjustment increases dwell time.

42. The ignition arrangement as claimed in claim 41 wherein:

the ignition arrangement is sized and adapted to fit under a distributor cap of said internal combustion engine.

43. The ignition arrangement as claimed in claim 41 wherein:

a second selected operating condition is dwell time; and said ignition arrangement checks and verifies, during a first dwell time, that said ignition coil associated with said internal combustion engine is wired correctly and that said ignition coil is not shorted.

44. The ignition arrangement as claimed in claim 41 wherein:

a second selected operating condition is engine running; and said adjustment decreases dwell time.

45. The ignition arrangement as claimed in claim 41 wherein:

a second selected operating condition is a value of said ignition coil current in said coil lower than a predetermined value just before spark in one of said spark plugs; and said adjustment increases dwell times.

46. The ignition arrangement as claimed in claim 41 wherein:

a second selected operating condition is a value of said ignition coil current in said coil greater than a preset value just before spark; and said adjustment decreases dwell time.

47. The ignition arrangement as claimed in claim 41 wherein:

for a second selected operating condition is an RPM of said internal combustion engine greater than a preset value; and said adjustment increases advance of said spark in said plurality of spark plugs.

48. The ignition arrangement as claimed in claim 41 wherein:

a second selected operating condition is engine not rotating; and said adjustment terminates dwell mode and waits for a power-on reset.

49. In combination; an ignition arrangement for analyzing a selected operating condition of an internal combustion engine and said engine having a crankshaft for rotating between a zero rotation condition and a predetermined maximum rotation condition, said engine having a predetermined number of spark plugs, a distributor with a distributor cap, a coil carrying electric current, and said coil having variable dwell periods, and said coil for sequentially generating a spark in said predetermined number of spark plugs, and making an adjustment to a designated engine parameter associated with said selected operating condition, in accordance with predetermined specifications, and sized and adapted to fit under said distributor cap of said distributor of said internal combustion engine, and in a first condition said selected operating condition is dwell time and said ignition arrangement checks and verifies, during a first dwell period, that said ignition coil associated with said internal combustion engine is wired correctly and that said ignition coil is not shorted;

in a second condition said selected operating condition is the value of ignition coil current greater than a preset value just before spark and in said second condition said adjustment decreases dwell period.

50. The ignition arrangement as claimed in claim 49 wherein:

in a third condition said selected operating condition is engine starting rotation and in said third condition said adjustment increases dwell period.

51. The ignition arrangement as claimed in claim 50 wherein:

in a fourth condition said selected operating condition is engine running and in said fourth condition said adjustment decreases dwell period.

52. The ignition arrangement as claimed in claim 51 wherein:

in a fifth condition said selected operating condition is the value of ignition coil current lower than a predetermined value just before spark and in said fifth condition said adjustment increases dwell period.

53. The ignition arrangement as claimed in claim 52 wherein:

in a sixth condition said selected operating condition is the RPM greater than a preset value and in said sixth condition said adjustment increases advance.

54. The ignition arrangement as claimed in claim 53 wherein:

in a seventh condition said selected operating condition is engine not turning over and in said seventh condition said adjustment terminates dwell mode and waits for a power-on.

55. In combination: an ignition arrangement for analyzing a selected operating condition of an internal combustion engine and said engine having a crankshaft for rotating between a zero rotation condition and a predetermined maximum rotation condition, said engine having a predetermined number of spark plugs, a distributor with a distributor cap, a coil carrying electric current, and said coil having variable dwell periods, and said coil for sequentially generating a spark in said predetermined number of spark plugs; and making an adjustment to a designated engine parameter associated with said selected operating condition, in accordance with predetermined specifications, and sized and adapted to fit under said distributor cap of said distributor of said internal combustion engine, and in a first condition said selected operating condition is dwell time and said ignition arrangement checks and verifies, during a first dwell period, that said ignition coil associated with said internal combustion engine is wired correctly and that said ignition coil is not shorted;

in a second condition said selected operating condition is engine rotating; and said adjustment decreases dwell period of said coil.

56. The ignition arrangement as claimed in claim 55 wherein:

in a third condition said selected operating condition is the value of ignition coil current in said coil lower than a predetermined value just before spark in one of said plurality of spark plugs; and in said third condition said adjustment increases dwell period of said coil.

57. The ignition arrangement as claimed in claim 55 wherein:

in a third condition said selected operating condition is rotational speed of said crankshaft greater than a preset value, and said adjustment increases advance.

58. The ignition arrangement as claimed in claim 55 wherein:

in a third condition said selected operating condition is said crankshaft not rotating; and in said third condition said adjustment terminates dwell mode and waits for said crankshaft to start rotation.

59. The arrangement defined in claim 20 wherein:

said selected operating condition is said crankshaft commencing rotation from said non-rotation condition thereof to said rotating condition thereof; and said adjustment increases said dwell period.

60. The arrangement defined in claim 20 wherein:

said selected operating condition is said crankshaft in said rotating condition; and said adjustment decreases said dwell period.

61. The arrangement as defined in claim 20 wherein:

said selected operating condition is the magnitude of said current in said ignition coil lower than a predetermined value just before a spark in one of said plurality of spark plugs, and said adjustment increases said dwell period.

62. The arrangement defined in claim 20 wherein:

said selected operating condition is the magnitude of said current in said ignition coil greater than a preset value just before spark in one of said plurality of spark plugs; and said adjustment decreases dwell period.

63. The arrangement defined in claim 20 wherein:

said selected operating condition is the rotational rate of said crankshaft greater than a preset value; and said adjustment increases advance.

64. The arrangement as claimed in claim 20 wherein:

said selected operating condition is said crankshaft of said engine in said non-rotating condition; and said adjustment terminates dwell mode and said adjustment re-commencing modification to said dwell mode for the condition of said crankshaft in said rotating condition thereof.

65. An ignition arrangement for an internal combustion engine having a drive shaft having a non-rotating condition for the condition of the engine not running and a variable rotational rate for the condition of the engine running, a rotary shaft drivingly coupled to and driven in synchronism rotation with the drive shaft, an ignition coil having a variable magnitude dwell period for the flow of current therethrough, a rotor and distributor arrangement and the distributor arrangement further having a distributor cap, and a plurality of spark plugs, the rotor and distributor arrangement coupled between the ignition coil and the spark plugs to effect sequential firing of the spark plugs, and adapted and sized to fit under said distributor cap, and the internal combustion engine having a plurality of operating conditions and a plurality of engine parameters associated with the operating conditions, said ignition arrangement comprising:

an ignitor module having a sensor;

said sensor responsive to the rotation of the rotary shaft to produce a series of electrical pulses having transitions representing the instantaneous position and rate of rotation of the rotary shaft; and said ignitor module operatively coupled to the ignition coil, said ignitor module responsive to receiving said series of electrical pulses from said sensor and sending a control signal to the ignition coil, said ignitor module analyzing said series of electrical pulses to determine selected operating conditions of the internal combustion engine, and making an adjustment to said control signal, thereby altering a designated engine parameter associated with said selected operating condition, in accordance with predetermined specifications.

66. The arrangement as defined in claim 65 wherein:

a first selected operating condition is the magnitude of said current in said ignition coil greater than a preset value just before spark in one of said plurality of spark plugs, and said adjustment decreases dwell period for said first selected operating condition; and a second selected operating condition is said engine commencing rotation thereof from said non-rotating condition, and said adjustment increases said dwell period for said second selected operating condition.

67. The arrangement defined in claim 65 wherein:

a first of said selected operating conditions is the rotational rate of said crankshaft greater than a preset value, and said adjustment increases advance for said first selected operating condition; and a second selected operating condition is said engine commencing rotation thereof from said non-rotating condition, and said adjustment increases said dwell period for said second selected operating condition.

68. The arrangement as claimed in claim 65 wherein:

a first of said selected operating conditions is said crankshaft of said engine in said non-rotating condition, and said adjustment terminates dwell mode for said second operating condition and said adjustment re-commencing modification to said dwell mode for the condition of said crankshaft in said rotating condition thereof; and, a second selected operating condition is said engine commencing rotation thereof from said non-rotating condition said adjustment increases said dwell period for said second selected operating condition.

69. The arrangement as claimed in claim 65 wherein:

a first of said selected operating conditions is said engine in said rotating condition thereof, and said adjustment decreases dwell period for said first operating condition; and a second selected operating condition is said engine commencing rotation thereof from said non-rotating condition, and said adjustment increases said dwell period for said second selected operating condition.

70. The arrangement as claimed in claim 65 wherein:

a first of said selected operating condition is the value of ignition coil current lower than a predetermined value just before spark, and said adjustment increases dwell period for said first operating condition; and a second selected operating condition is said engine commencing rotation thereof from said non-rotating condition said adjustment increases said dwell period for said second selected operating condition.

71. The arrangement as claimed in claim 66 wherein:

a third of said selected operating conditions is said engine in said rotating condition thereof running, and said adjustment decreases dwell period for said third operating condition thereof.

72. The arrangement as claimed in claim 66 wherein:

a third of said selected operating conditions is the rotational rate of said crankshaft greater than a preset value, and said adjustment increases advance for said third selected operating condition.

73. The arrangement as claimed in claim 66 wherein:

a third of said selected operating conditions is the value of ignition coil current lower than a predetermined value just before spark, and said adjustment increases dwell period for said third operating condition.

74. The arrangement as claimed in claim 66 wherein:

a third of said selected operating conditions is said crankshaft of said engine in said non-rotating condition, and said adjustment terminates dwell mode for said third operating condition and said adjustment re-commencing modification to said dwell mode for the condition of said crankshaft in said rotating condition thereof.

* * * * *